US008915573B2

(12) United States Patent
Tu et al.

(10) Patent No.: US 8,915,573 B2
(45) Date of Patent: Dec. 23, 2014

(54) INKJET PRINTING DEVICE

(71) Applicant: Primax Electronics Ltd., Taipei (TW)

(72) Inventors: Tung-Wen Tu, Taipei (TW); Yan-Hua Li, Taipei (TW)

(73) Assignee: Primax Electronics Ltd., Neihu (TW)

( * ) Notice: Subject to any disclaimer, the term of this patent is extended or adjusted under 35 U.S.C. 154(b) by 61 days.

(21) Appl. No.: 13/737,567

(22) Filed: Jan. 9, 2013

(65) Prior Publication Data

US 2014/0125732 A1 May 8, 2014

(30) Foreign Application Priority Data

Nov. 2, 2012 (CN) ..... 2012 1 0433670

(51) Int. Cl.
*B41J 2/165* (2006.01)
*B41J 2/175* (2006.01)

(52) U.S. Cl.
CPC ..... *B41J 2/17506* (2013.01); *B41J 2/16523* (2013.01); *B41J 2/17596* (2013.01)
USPC ..... 347/30; 347/20; 347/22; 347/29

(58) Field of Classification Search
CPC ..... B41J 2/16523; B41J 2/16532; B41J 2/16508; B41J 2/1652; B41J 2/16547
See application file for complete search history.

(56) References Cited

U.S. PATENT DOCUMENTS

| | | | | |
|---|---|---|---|---|
| 6,883,896 | B2 * | 4/2005 | Umeda | 347/29 |
| 7,318,638 | B2 * | 1/2008 | Shimizu et al. | 347/30 |
| 7,547,089 | B2 * | 6/2009 | Uchida | 347/30 |
| 2007/0035574 | A1 * | 2/2007 | Taga et al. | 347/23 |
| 2009/0051728 | A1 * | 2/2009 | Miyazawa | 347/30 |
| 2010/0118082 | A1 * | 5/2010 | Tojo | 347/30 |

* cited by examiner

*Primary Examiner* — Manish S Shah
*Assistant Examiner* — Jeremy Delozier
(74) *Attorney, Agent, or Firm* — Kirton McConkie; Evan R. Witt

(57) ABSTRACT

An inkjet printing device includes at least one ink cartridge, at least one ink pipe, at least one print head, an ink refill mechanism, and a pump module. The ink refill mechanism includes at least one transfer channel. After the ink refill mechanism is enabled and the at least one transfer channel is in an open status, in response to a suction generated by the pump module, the air within the at least one print head is ejected out through the at least one transfer channel, and the ink within the at least one ink cartridge is transferred to the at least one print head through the at least one ink pipe.

13 Claims, 13 Drawing Sheets

INKJET PRINTING DEVICE

FIELD OF THE INVENTION

The present invention relates to an inkjet printing device, and more particularly to an inkjet printing device for performing an inkjet printing task.

BACKGROUND OF THE INVENTION

A printing device is a peripheral device of a computer. Generally, the printing device is in communication with the computer. By operating the computer, a document electronic file stored in the computer may be printed on a paper through the printing device. Consequently, a paper document corresponding to document electronic file may be generated by the printing device. For example, the document electronic file is a text file or an image file. Moreover, an inkjet printing device is a printing device that uses ink as the printing material.

FIG. 1 is a schematic perspective view illustrating the outward appearance of a conventional inkjet printing device. As shown in FIG. 1, the conventional inkjet printing device 1 comprises a print head 10, a first ink cartridge 11, a second ink cartridge 12, a transmission mechanism 13, a paper input tray 14, and a paper output tray 15. The first ink cartridge 11 is used for storing a first ink (not shown). The second ink cartridge 12 is located beside the first ink cartridge 11 and used for storing a second ink (not shown). For example, the first ink is a black ink, and the second ink is a color ink. The print head 10 comprises a first ink chamber 101, a first nozzle (not shown), a second chamber 102, and a second nozzle (not shown). The first ink chamber 101 is connected with the first ink cartridge 11 for storing the first ink which is transferred from the first ink cartridge 11. The second chamber 102 is connected with the second ink cartridge 12 for storing the second ink which is transferred from the second ink cartridge 12. The first nozzle is connected with the first ink chamber 101. The first ink stored within the first ink chamber 101 may be ejected through the first nozzle. The second nozzle is connected with the second chamber 102. The second ink stored within the second chamber 102 may be ejected through the second nozzle. The transmission mechanism 13 is connected with the print head 10. The transmission mechanism 13 is driven to move the print head 10, so that the first ink or the second ink may be ejected out and printed on any position of a blank paper P in an inkjet printing manner. The paper input tray 14 is used for placing the blank paper P thereon. After an inkjet printing task is performed, the paper P is exited to the paper output tray 15.

During the inkjet printing task of the conventional inkjet printing device 1 is performed, the blank paper P on the paper input tray 14 is fed into the inkjet printing device 1 in a feeding direction Y by a feeding mechanism (not shown), and the print head 10 is moved in a printing direction X by the transmission mechanism 13. The printing direction X is perpendicular to the feeding direction Y. After the inkjet printing task is completed, the paper P is exited to the paper output tray 15. The structures of the conventional inkjet printing device 1 and the printing process of the conventional inkjet printing device 1 have been mentioned above. However, if the inkjet printing task is repeatedly performed by the conventional inkjet printing device 1, two problems may occur. As for the first problem, the first nozzle and the second nozzle of the print head 10 are possibly clogged. In a case that the first nozzle and the second nozzle are clogged by dust, foreign matter or bubbles, the print head 10 fails to eject ink. Secondly, the first ink chamber 101 and the second chamber 102 are sealed structures and unable to be opened. Consequently, in a case that the first ink within the first ink chamber 101 and the second ink within the second ink chamber 102 are used up, the first ink chamber 101 and the second chamber 102 fail to be opened to be replenished with the first ink and the second ink. The second problem is to realize how to transfer the first ink within the first ink cartridge 11 and the second ink within the second ink cartridge 12 to the first ink chamber 101 and the second chamber 102.

For solving the above two problems, the inkjet printing device is usually equipped with a nozzle cleaning mechanism for preventing from occurrence of the clogged conditions of the nozzles. Hereinafter, the structures of a nozzle cleaning mechanism of a conventional inkjet printing device will be illustrated with reference to FIG. 2. FIG. 2 is a schematic perspective view illustrating a nozzle cleaning mechanism of a conventional inkjet printing device. The nozzle cleaning mechanism 16 is disposed within the conventional inkjet printing device 1 for eliminating the clogged conditions of the first nozzle and the second nozzle. As shown in FIG. 2, the nozzle cleaning mechanism 16 comprises a power pump 161, a connecting cover 162, a first duct 163, a second duct 164, a first discharge pipe 165, a second discharge pipe 166, and a storage element 167. The connecting cover 162 is connected with a first end 1631 of the first duct 163 and a first end 1641 of the second duct 164. The connecting cover 162 may be moved to a position to be contacted with the print head 10, so that the first nozzle and second nozzle are covered by the connecting cover 162. The power pump 161 is connected with a second end 1632 of the first duct 163 and a second end 1642 of the second duct 164. The power pump 161 may be driven to generate a suction force. In response to the suction force, the first ink within the first ink cartridge 11 and the second ink within the second ink cartridge 12 are sucked by the power pump 161. A first end 1651 of the first discharge pipe 165 is connected with the power pump 161. The first discharge pipe 165 is used for discharging the first ink that is sucked by the power pump 161. A first end 1661 of the second discharge pipe 166 is also connected with the power pump 161. The second discharge pipe 166 is used for discharging the second ink that is sucked by the power pump 161. The storage element 167 is connected with a second end 1652 of the first discharge pipe 165 and a second end 1662 of the second discharge pipe 166. The storage element 167 is used for storing the sucked first ink and the sucked second ink. For example, the storage element 167 is a waste ink box.

If the user finds that the first nozzle of the print head 10 has been clogged, the nozzle cleaning mechanism 16 may be enabled to have the connecting cover 162 move to a position under the print head 10 and cover the first nozzle and second nozzle. After the connecting cover 162 is coupled with the print head 10, the power pump 161 may be driven to generate a suction force. In response to the suction force, the first ink within the first ink chamber 101 is sucked by the power pump 161 and transferred through the first nozzle. At the time when the first ink is transferred through the first nozzle, the dust, foreign matter or bubbles within the first nozzle is flushed out of the first nozzle by the first ink, and thus the clogged condition of the first nozzle is minimized or eliminated. Then, the sucked first ink is sequentially transferred through the first duct 163, the power pump 161 and the first discharge pipe 165, and delivered to the storage element 167 for storage. Meanwhile, the nozzle cleaning task of the print head 10 is completed. Then, the connecting cover 162 is separated from the print head 10, and the conventional inkjet printing device 1 is in a ready-to-print status. The way of eliminating the clogged condition of the second nozzle is similar to the way of eliminating the clogged condition of the first nozzle, and is not redundantly described herein. As a consequence, the first problem of causing the clogged nozzle is solved.

Moreover, the use of the nozzle cleaning mechanism 16 is also capable of solving the second problem of realizing how to transfer the first ink and the second ink to the first ink chamber 101 and the second chamber 102. For refilling the first ink from the first ink cartridge 11 to the first ink chamber 101, the nozzle cleaning mechanism 16 may be enabled to have the connecting cover 162 move to a position under the print head 10 and cover the first nozzle and second nozzle. After the connecting cover 162 is coupled with the print head 10, the power pump 161 may be driven to generate a suction force. In response to the suction force, the air within the first ink chamber 101 is transferred through the first nozzle and ejected out. In addition, the air is sequentially transferred through the first duct 163 and the power pump 161, and then ejected out of the inkjet printing device 1. Meanwhile, no air is contained in the first ink chamber 101. Since the first ink chamber 101 is connected with the first ink cartridge 11, in response to the change of the pressure within the first ink chamber 101, the first ink within first ink cartridge 11 is transferred from the first ink cartridge 11 to the first ink chamber 101 in order to refill ink. As a consequence, the second problem of refilling ink is solved.

Although the use of the nozzle cleaning mechanism is effective to eliminate the clogged conditions of the first nozzle and the second nozzle, there are still some drawbacks. For example, if the first ink within the first ink chamber 101 and the second ink within the second ink chamber 102 contain bubbles, the presence of the bubbles may cause non-uniform distribution of the first ink and the second ink. Under this circumstance, the printing quality is deteriorated. As known, the conventional nozzle cleaning mechanism is unable to effectively remove the bubbles from the first ink and the second ink. Therefore, there is a need of providing an inkjet printing device capable of removing the bubbles from the ink.

SUMMARY OF THE INVENTION

The present invention provides an inkjet printing device capable of removing the bubbles from the ink.

In accordance with a first aspect of the present invention, there is provided an inkjet printing device. The inkjet printing device includes a first ink cartridge, a second ink cartridge, a first ink pipe, a second ink pipe, a first print head, a second print head, an ink refill mechanism, and a pump module. The first ink cartridge is used for storing a first ink. The second ink cartridge is used for storing a second ink. The first ink pipe is connected with the first ink cartridge, wherein the first ink is allowed to be transferred through the first ink pipe. The second ink pipe is connected with the second ink cartridge, wherein the second ink is allowed to be transferred through the second ink pipe. The first print head is connected with the first ink pipe, and includes a first ink chamber, a first nozzle and a first vent. The second print head is connected with the second ink pipe, and includes a second ink chamber, a second nozzle and a second vent. The ink refill mechanism is disposed under the first print head and the second print head. When the ink refill mechanism is connected with the first vent and the second vent, the first ink within the first ink cartridge and the second ink within the second ink cartridge are allowed to be transferred to the first ink chamber and the second ink chamber through the first ink pipe and the second ink pipe, respectively. Moreover, the ink refill mechanism includes a channel plate, a first switching module, and an exhaust pipe. The channel plate includes a first transfer channel corresponding to the first vent and a second transfer channel corresponding to the second vent. The first transfer channel and the second transfer channel are parallel with the channel plate. The first transfer channel has a first channel exit perpendicular to the channel plate. The second transfer channel has a second channel exit perpendicular to the channel plate. The first switching module is connected with the first channel exit and the second channel exit for controlling open/close statues of the first transfer channel and the second transfer channel. The exhaust pipe is disposed under the first channel exit and the second channel exit, and located near the first channel exit and the second channel exit. When the first transfer channel or the second transfer channel is in the open status, an air within the first ink chamber or the second ink chamber is allowed to be transferred through the exhaust pipe. The pump module is connected with the exhaust pipe for generating a suction force. When the first transfer channel is in the open status, the air within the first ink chamber is sucked by the pump module in response to the suction force. When the second transfer channel is in the open status, the air within the second ink chamber is sucked by the pump module in response to the suction force.

In an embodiment, the first switching module includes a first gate mechanism, a second gate mechanism, and a changeover switch. The first gate mechanism is inserted into the first channel exit for selectively unblocking or blocking the first channel exit. When the first channel exit is unblocked, the first transfer channel is in the open status. Whereas, when the first channel exit is blocked, the first transfer channel is in the close status. The second gate mechanism is inserted into the second channel exit for selectively unblocking or blocking the second channel exit. When the second channel exit is unblocked, the second transfer channel is in the open status. Whereas, when the second channel exit is blocked, the second transfer channel is in the close status. The changeover switch is located beside the first gate mechanism and the second gate mechanism to be selectively contacted with the first gate mechanism or the second gate mechanism, thereby driving the first gate mechanism or the second gate mechanism.

In an embodiment, the first gate mechanism includes a first sealing element, a first contact post, a first pushing element, and a first elastic element. The first sealing element is disposed within the first channel exit, and includes a first hole. The first contact post is inserted into the first channel exit and the first hole, and movable relative to the first channel exit. The first pushing element is disposed under the first contact post, and movable relative to the first channel exit. When the first pushing element is pushed by the changeover switch, the first pushing element is correspondingly moved to push the first contact post, so that at least one first gap is formed between the first contact post and the first hole and the first channel exit is unblocked. The first elastic element is disposed within the first channel exit and contacted with the first contact post for providing a first elastic force to the first contact post. In response to the first elastic force, the first channel exit is blocked by the first contact post.

In an embodiment, the first contact post includes a first contact part and a first notch part. The first contact part is located at a first end of the first contact post, and inserted into the first channel exit. A first surface of the first contact part is contacted with the first elastic element. A second surface of the first contact part is contacted with the first sealing element. The first notch part is located at a second end of the first contact post, and inserted into the first hole to be selectively contacted with the first pushing element. When the first notch part is not pushed by the first pushing element, the first hole is covered by the first contact part, so that the first channel exit is blocked. When the first notch part is pushed by the first pushing element, the first notch part is moved upwardly relative to the first hole, so that the at least one first gap is formed between the first notch part and the first hole and the first channel exit is unblocked.

In an embodiment, the first pushing element includes a first pushing part and a first thimble. The first pushing part is located beside the changeover switch. When the first pushing part is pushed by the changeover switch, the first pushing part is moved relative to the first channel exit. The first thimble is disposed on the first pushing part to be contacted with the first contact post. When the first pushing part is pushed by the changeover switch, the first thimble is correspondingly moved to push the first contact post, so that the at least one first gap is formed between the first contact post and the first hole and the first channel exit is unblocked.

In an embodiment, the second gate mechanism includes a second sealing element, a second contact post, a second pushing element, and a second elastic element. The second sealing element is disposed within the second channel exit, and includes a second hole. The second contact post inserted into the second channel exit and the second hole, and movable relative to the second channel exit. The second pushing element is disposed under the second contact post, and movable relative to the second channel exit. When the second pushing element is pushed by the changeover switch, the second pushing element is correspondingly moved to push the second contact post, so that at least one second gap is formed between the second contact post and the second hole and the second channel exit is unblocked. The second elastic element is disposed within the second channel exit and contacted with the second contact post for providing a second elastic force to the second contact post. In response to the second elastic force, the second channel exit is blocked by the second contact post.

In an embodiment, the second contact post includes a second contact part and a second notch part. The second contact part is located at a first end of the second contact post, and inserted into the second channel exit. A first surface of the second contact part is contacted with the second elastic element. A second surface of the second contact part is contacted with the second sealing element. The second notch part is located at a second end of the second contact post, and inserted into the second hole to be selectively contacted with the second pushing element. When the second notch part is not pushed by the second pushing element, the second hole is covered by the second contact part, so that the second channel exit is blocked. Wherein, when the second notch part is pushed by the second pushing element, the second notch part is moved upwardly relative to the second hole, so that the at least one second gap is formed between the second notch part and the second hole and the second channel exit is unblocked.

In an embodiment, the second pushing element includes a second pushing part and a second thimble. The second pushing part is located beside the changeover switch. When the second pushing part is pushed by the changeover switch, the second pushing part is moved relative to the second channel exit. The second thimble is disposed on the second pushing part to be contacted with the second contact post. When the second pushing part is pushed by the changeover switch, the second thimble is correspondingly moved to push the second contact post, so that the at least one second gap is formed between the second contact post and the second hole and the second channel exit is unblocked.

In an embodiment, the first switching module further includes a first casing. The first gate mechanism and the second gate mechanism are partially enclosed by the first casing. The changeover switch includes a rotating part and a pushing bulge. The rotating part is disposed on the first casing and rotatable relative to the first casing. The pushing bulge is disposed on an inner surface of the rotating part. As the rotating part is rotated, the first gate mechanism or the second gate mechanism is pushed by the pushing bulge.

In an embodiment, the ink refill mechanism further includes a carrier, a covering member, and a swinging seat. The carrier is used for supporting the first switching module thereon. The covering member is disposed under the first channel exit and the second channel exit, and partially sheltered by the first switching module. The covering member is connected with the exhaust pipe. The swinging seat is disposed under the carrier and contacted with the carrier for swinging the carrier to move the carrier upwardly or downwardly. When the carrier is moved upwardly, the ink refill mechanism is connected with the first vent and the second vent. Whereas, when the carrier is moved downwardly, the ink refill mechanism is detached from the first vent and the second vent.

In an embodiment, the inkjet printing device further includes a nozzle cleaning mechanism. The nozzle cleaning mechanism is located beside the ink refill mechanism and connected with the pump module. When the nozzle cleaning mechanism is connected with the first nozzle, in response to the suction force generated by the pump module, a clogged condition of the first nozzle is eliminated by the nozzle cleaning mechanism. The nozzle cleaning mechanism includes a first duct and a second switching module. The first duct is connected with the pump module. The first ink within the first ink cartridge is allowed to be transferred to the pump module through the first duct. The second switching module is located near the exhaust pipe and the first duct for controlling open/close statues of the first duct and the exhaust pipe. When the exhaust pipe or the first duct is in the open status, in response to the suction force generated by the pump module, the air within the first ink chamber, the air within the second ink chamber or the first ink is transferred to the pump module.

In an embodiment, the second switching module includes a second casing, a rotating shaft, a third gate mechanism, and a fourth gate mechanism. The rotating shaft is disposed on the second casing and rotatable relative to the second casing. The third gate mechanism is connected with the rotating shaft and located near the exhaust pipe. The third gate mechanism is oriented along a first direction. As the rotating shaft is rotated, the exhaust pipe is pressed by the third gate mechanism or separated from the third gate mechanism, so that the exhaust pipe is in the close status or the open status. The fourth gate mechanism is connected with the rotating shaft, located beside the third gate mechanism, and located near the first duct. The fourth gate mechanism is oriented along a second direction. As the rotating shaft is rotated, the first duct is pressed by the fourth gate mechanism or separated from the fourth gate mechanism, so that the first duct is in the close status or the open status. There is an included angle between the first direction and the second direction. When the third gate mechanism is separated from the exhaust pipe, the first duct is pressed by the fourth gate mechanism. Whereas, when the third gate mechanism is separated from the first duct, the exhaust pipe is pressed by the fourth gate mechanism.

In an embodiment, the third gate mechanism includes a first cam, a first contact plate, and a third elastic element. The first cam is disposed on the rotating shaft, and located near the exhaust pipe. The first cam is oriented along the first direction. The first cam is rotated with the rotating shaft. The first contact plate is disposed around the first cam and the rotating shaft. When the first contact plate is not pushed by the first cam, the exhaust pipe is pressed by the first contact plate, so that the exhaust pipe is in the close status. When the first cam is rotated and the first contact plate is pushed by the first cam, the first contact plate is moved relative to the second casing and separated from the exhaust pipe, so that the exhaust pipe is in the open status and the first duct is in the close status. The third elastic element is arranged between the second casing and the first contact plate and contacted with the second casing and the first contact plate for providing a third elastic force to the first contact plate. When the first contact plate is not pushed by the first cam, in response to the third elastic force, the first contact plate is moved relative to the second casing to press the exhaust pipe.

In an embodiment, the fourth gate mechanism includes a second cam, a second contact plate, and a fourth elastic element. The second cam is disposed on the rotating shaft, and located near the first duct. The second cam is oriented along the second direction. The second cam is rotated with the rotating shaft. The second contact plate is disposed around the second cam and the rotating shaft. When the second contact plate is not pushed by the second cam, the first duct is pressed by the second contact plate, so that the first duct is in the close status. When the second cam is rotated and the second contact plate is pushed by the second cam, the second contact plate is moved relative to the second casing and separated from the first duct, so that the first duct is in the open status and the exhaust pipe is in the close status. The fourth elastic element is arranged between the second casing and the second contact plate and contacted with the second casing and the second contact plate for providing a fourth elastic force to the second contact plate. When the second contact plate is not pushed by the second cam, in response to the fourth elastic force, the second contact plate is moved relative to the second casing to press the first duct.

In an embodiment, the pump module includes a power pump, a suction pipe, a discharge pipe, a storage element, and a coupling element. The power pump is used for generating the suction force. The suction pipe is connected with the power pump. The discharge pipe is connected with the power pump. After the first ink is transferred through the power pump in response to the suction force, the first ink is further transferred through the discharge pipe. The storage element is connected with the discharge pipe. After the first ink is transferred through the discharge pipe, the first ink is stored within the storage element. The coupling element is arranged between the suction pipe and the exhaust pipe and the first duct, and connected with the suction pipe, the exhaust pipe and the first duct. The coupling element includes an outlet, a first inlet, and a second inlet. The outlet is located at a first sidewall of the coupling element and connected with the suction pipe. The first inlet is located at a second sidewall of the coupling element and connected with the exhaust pipe. The air within the first ink chamber is introduced into the coupling element through the first inlet and transferred to the suction pipe through the outlet. The second inlet is located at the second sidewall of the coupling element, located beside the first inlet, and connected with the first duct. The first ink is introduced into the coupling element through the second inlet and transferred to the suction pipe through the outlet.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For eliminating the drawbacks encountered from the prior art, the present invention provides an inkjet printing device.

Figure 1:
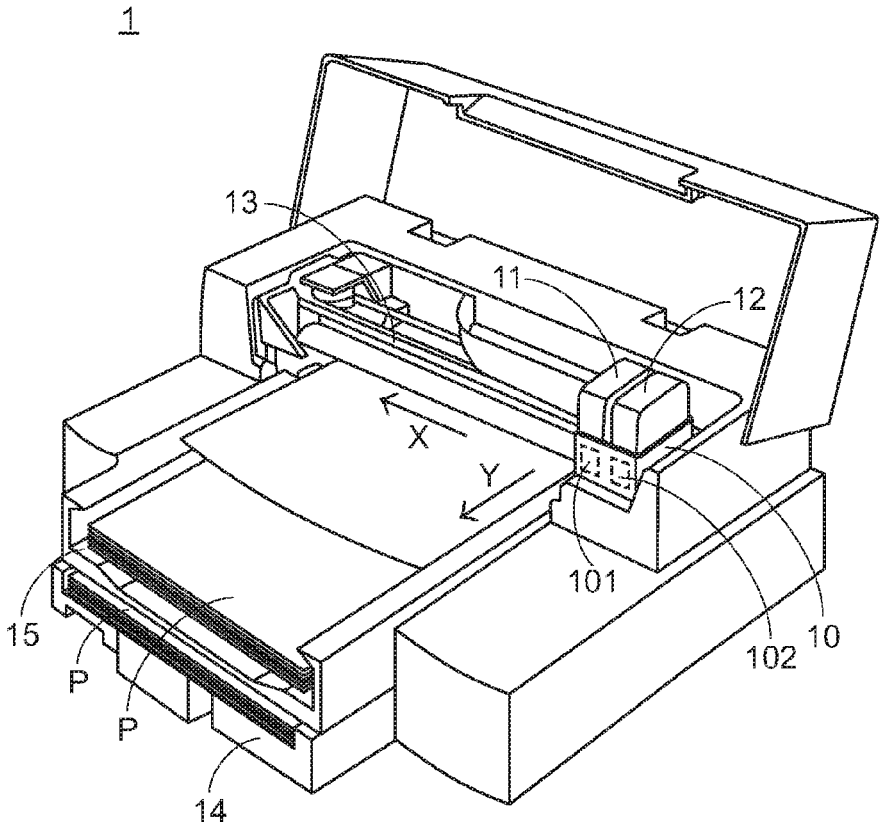
FIG.1 PRIOR ART
FIG. 1 is a schematic perspective view illustrating the outward appearance of a conventional inkjet printing device.
Figure 2:
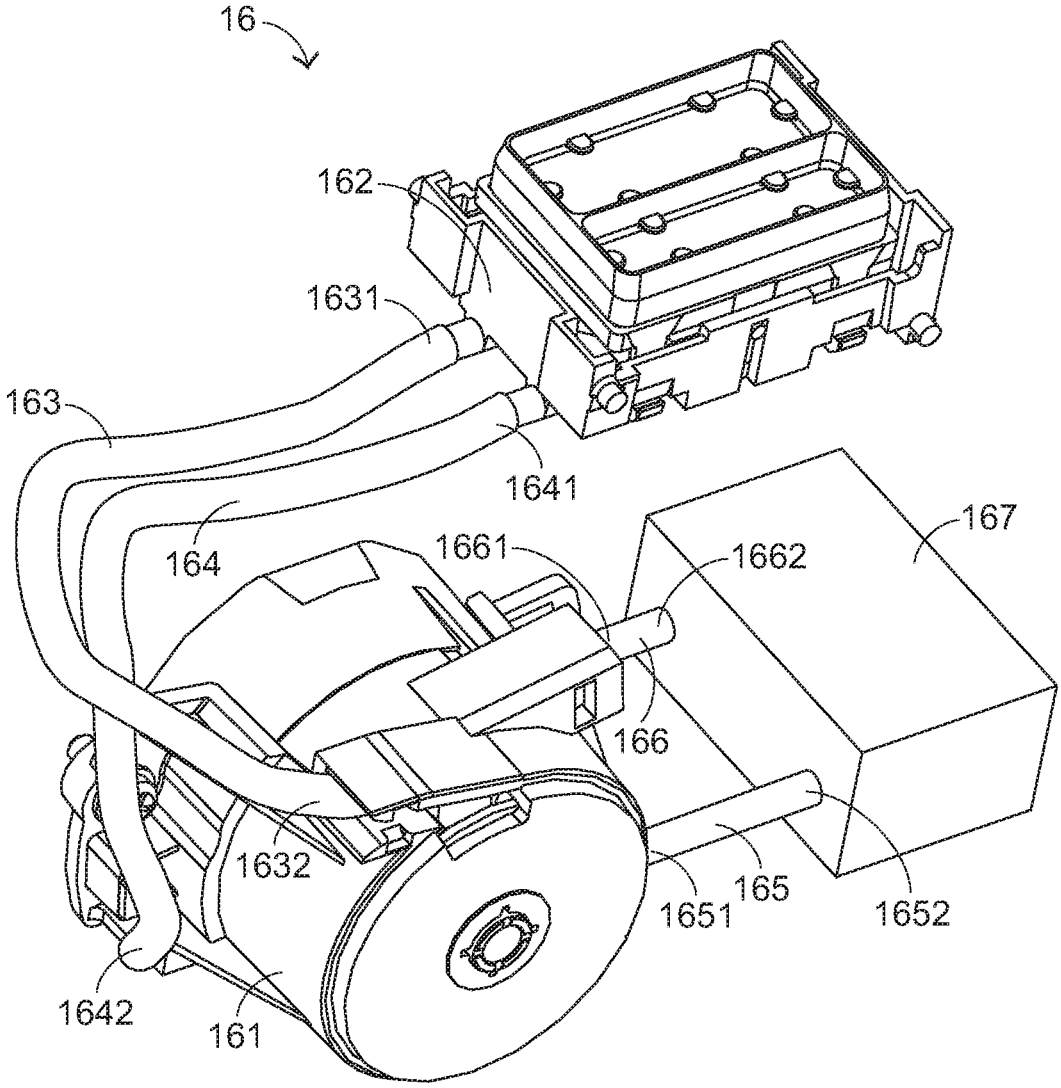
FIG. 2 PRIOR ART
FIG. 2 is a schematic perspective view illustrating a nozzle cleaning mechanism of a conventional inkjet printing device.
Figure 3:
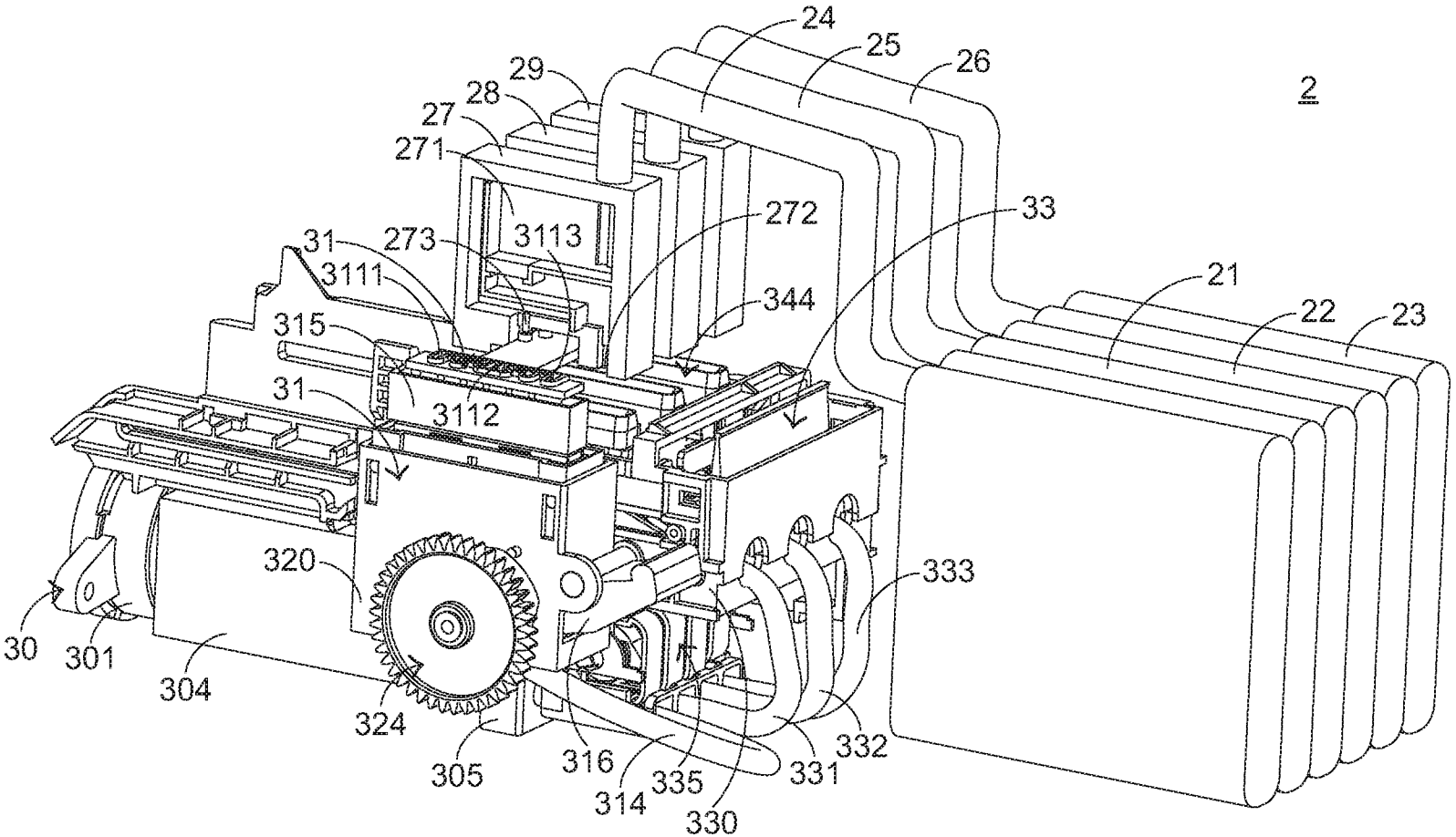
FIG. 3 is a schematic perspective view illustrating an inkjet printing device according to an embodiment of the present invention.

FIG. 3 is a schematic perspective view illustrating an inkjet printing device according to an embodiment of the present invention. As shown in FIG. 3, the inkjet printing device 2 comprises a first ink cartridge 21, a second ink cartridge 22, a third ink cartridge 23, a first ink pipe 24, a second ink pipe 25, a third ink pipe 26, a first print head 27, a second print head 28, a third print head 29, a pump module 30, an ink refill mechanism 31, and a nozzle cleaning mechanism 33. For clarification and brevity, the other components of the inkjet printing device 2 are not shown in FIG. 3. The first ink cartridge 21 is used for storing a first ink (not shown). The second ink cartridge 22 is located beside the first ink cartridge 21 and used for storing a second ink (not shown). Similarly, the third ink cartridge 23 is located beside the second ink cartridge 22 and used for storing a third ink (not shown). In an embodiment, the first ink is a black ink, the second ink is a color ink, and the third ink is a gray ink.

Please refer to FIG. 3 again. The first ink pipe 24 is connected with the first ink cartridge 21. The first ink may be transferred through the first ink pipe 24. The second ink pipe 25 is located beside the first ink pipe 24 and connected with the second ink cartridge 22. The second ink may be transferred through the second ink pipe 25. The third ink pipe 26 is located beside the second ink pipe 25 and connected with the third ink cartridge 23. The third ink may be transferred through the third ink pipe 26. The first print head 27 is connected with the first ink pipe 24. In addition, the first print head 27 comprises a first ink chamber 271, a first nozzle 272, and at least one first vent 273 (e.g. only one first vent 273 is shown in FIG. 3). The first ink chamber 271 is used for storing the first ink which is transferred from the first ink cartridge 21. The first nozzle 272 is located at a lower portion of the first print head 27 and located at a first side of the first print head 27. The first ink within the first ink chamber 271 may be ejected through the first nozzle 272. The first vent 273 is located at the lower portion of the first print head 27 and located at a second side of the first print head 27. The air within the first ink chamber 271 may be transferred through the first vent 273. The second print head 28 is located beside the first print head 27 and connected with the second ink pipe 25. In addition, the second print head 28 comprises a second ink chamber (not shown), a second nozzle (not shown), and at least one second vent (not shown). The third print head 29 is located beside the second print head 28 and connected with the third ink pipe 26. In addition, the third print head 29 comprises a third ink chamber (not shown), a third nozzle (not shown), and at least one third vent (not shown). The structures and functions of the second print head 28 and the third print head 29 are identical to those of the first print head 27, and are not redundantly described herein.

The pump module 30 is connected with the ink refill mechanism 31 and the nozzle cleaning mechanism 33. The pump module 30 is used for generating a suction force. The ink refill mechanism 31 is disposed under the first print head 27, the second print head 28 and the third print head 29, and connected with the pump module 30. In a case that the ink refill mechanism 31 is connected with the first vent 273, the second vent and the third vent, the first ink within the first ink cartridge 21, the second ink within the second ink cartridge 22 and the third ink within the third ink cartridge 23 may be transferred to the first ink chamber 271, the second ink chamber and the third ink chamber through the first ink pipe 24, the second ink pipe 25 and the third ink pipe 26, respectively. Consequently, an ink-refilling task may be performed. Moreover, the nozzle cleaning mechanism 33 is located at a side of the ink refill mechanism 31 and connected with the pump module 30. In a case that the nozzle cleaning mechanism 33 is connected with the first nozzle 272, the second nozzle and the third nozzle, the nozzle cleaning mechanism 33 may eliminate the clogged conditions of the first nozzle 272, the second nozzle and the third nozzle in response to the suction force generated by the pump module 30.

Figure 4:
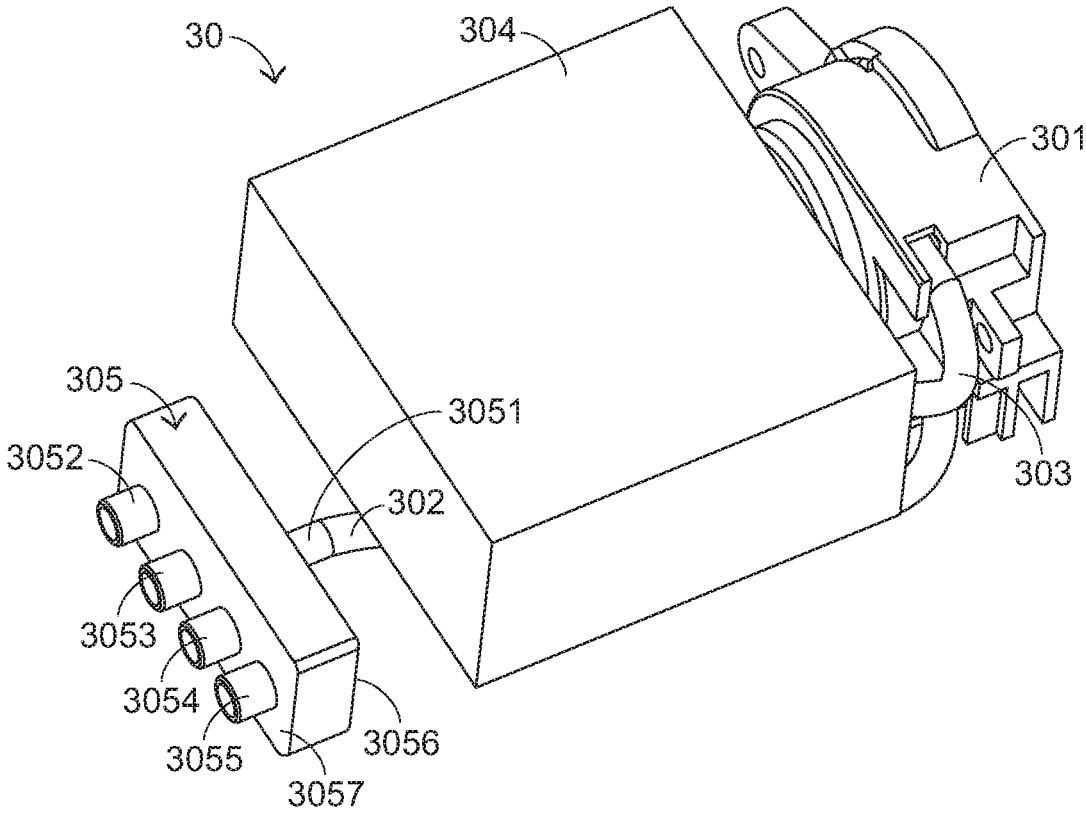
FIG. 4 is a schematic perspective view illustrating the pump module of the inkjet printing device according to the embodiment of the present invention.

FIG. 4 is a schematic perspective view illustrating the pump module of the inkjet printing device according to the embodiment of the present invention. Please refer to FIGS. 3 and 4. The pump module 30 comprises a power pump 301, a suction pipe 302, a discharge pipe 303, a storage element 304, and a coupling element 305. The power pump 301 is used for generating the suction force. The suction pipe 302 is connected with the power pump 301. The discharge pipe 303 is connected with the power pump 301. After the first ink, the second ink and the third ink are transferred through the power pump 301 in response to the suction force, the first ink, the second ink and the third ink are transferred through the discharge pipe 303. The storage element 304 is connected with the discharge pipe 303. After the first ink, the second ink and the third ink are transferred through the discharge pipe 303, the first ink, the second ink and the third ink are stored within the storage element 304. In this embodiment, the storage element 304 is an ink-absorbing cotton. Alternatively, in some other embodiments, the storage element 304 is a waste ink cartridge or a waste ink box.

The coupling element 305 is arranged between the suction pipe 302 and the ink refill mechanism 31 and the nozzle cleaning mechanism 33. In addition, the coupling element 305 is connected with the suction pipe 302, the ink refill mechanism 31 and the nozzle cleaning mechanism 33. The coupling element 305 comprises an outlet 3051, a first inlet 3052, a second inlet 3053, a third inlet 3054, and a fourth inlet 3055. The outlet 3051 is located at a first sidewall 3056 of the coupling element 305, and connected with the suction pipe 302. The first inlet 3052 is located at a second sidewall 3057 of the coupling element 305, and connected with the ink refill mechanism 31. The air within the first ink chamber 271 may be introduced into the coupling element 305 through the first inlet 3052 and transferred to the suction pipe 302 through the outlet 3051. The second inlet 3053 is located beside the first inlet 3052, and connected with the nozzle cleaning mechanism 33. The first ink which is outputted from the first ink chamber 271 through the first nozzle 272 may be introduced into the coupling element 305 through the second inlet 3053 and transferred to the suction pipe 302 through the outlet 3051. Similarly, the third inlet 3054 is located beside the second inlet 3053, and connected with the nozzle cleaning mechanism 33. The second ink which is outputted from the second ink chamber 271 through the second nozzle may be introduced into the coupling element 305 through the third inlet 3054 and transferred to the suction pipe 302 through the outlet 3051. Similarly, the fourth inlet 3055 is located beside the third inlet 3054, and connected with the nozzle cleaning mechanism 33. The third ink which is outputted from the third ink chamber through the third nozzle may be introduced into the coupling element 305 through the fourth inlet 3055 and transferred to the suction pipe 302 through the outlet 3051. In this embodiment, the outlet 3051, the first inlet 3052, the second inlet 3053, the third inlet 3054 and the fourth inlet 3055 are integrally formed with the coupling element 305.

Figure 5:
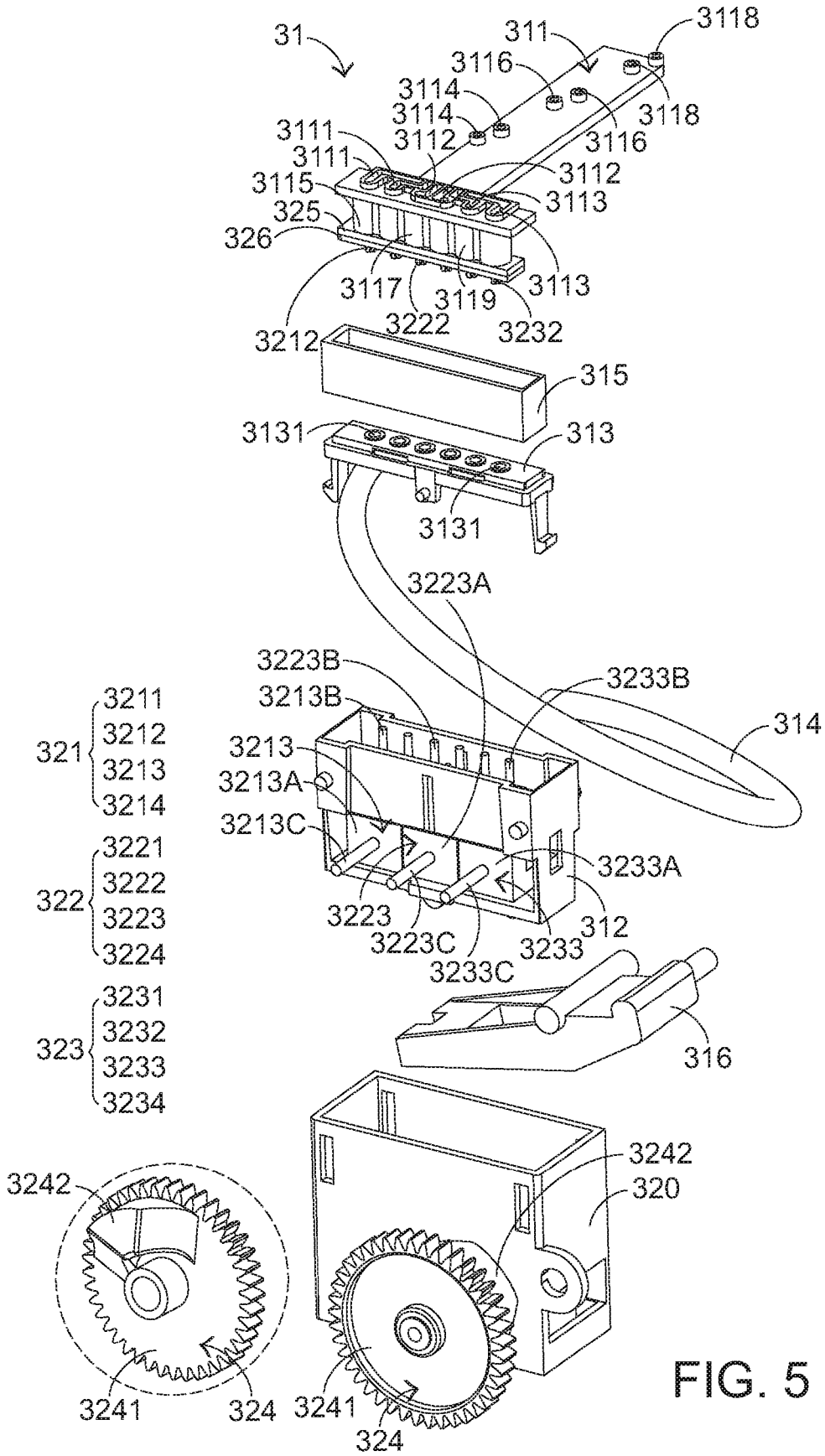
FIG. 5 is a schematic exploded view illustrating the ink refill mechanism of the inkjet printing device according to the embodiment of the present invention.
Figure 6:
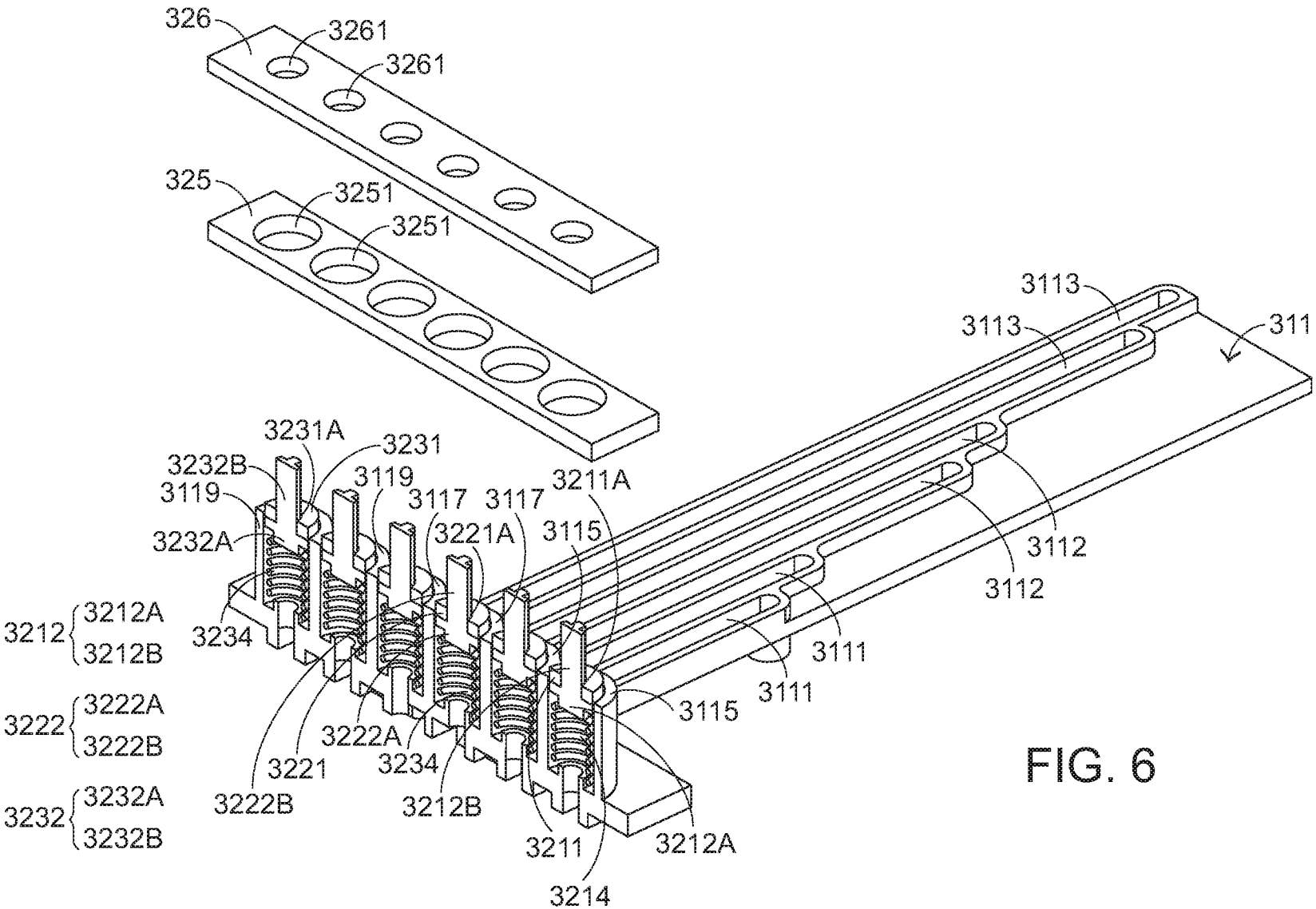
FIG. 6 is a schematic partial exploded view illustrating the ink refill mechanism of the inkjet printing device according to the embodiment of the present invention and taken along another viewpoint.

Hereinafter, the structures of the ink refill mechanism 31 will be illustrated with reference to FIGS. 5 and 6. FIG. 5 is a schematic exploded view illustrating the ink refill mechanism of the inkjet printing device according to the embodiment of the present invention. FIG. 6 is a schematic partial exploded view illustrating the ink refill mechanism of the inkjet printing device according to the embodiment of the present invention and taken along another viewpoint. As shown in FIGS. 5 and 6, the ink refill mechanism 31 comprises a channel plate 311, a carrier 312, a covering member 313, an exhaust pipe 314, a protective cover 315, a swinging seat 316, and a first switching module 317 (see FIG. 7). The channel plate 311 comprises at least one first transfer channel 3111 corresponding to the at least one first vent 273, at least one second transfer channel 3112 corresponding to the at least one second vent, and at least one third transfer channel 3113 corresponding to the at least one third vent. In this embodiment, the channel plate 311 comprises two first transfer channels 3111, two second transfer channels 3112, and two third transfer channels 3113. Moreover, the first transfer channels 3111 are parallel with the channel plate 311. Each of the first transfer channels 3111 comprises a first connecting port 3114 corresponding to the first vent 273 and a first channel exit 3115. The first connecting port 3114 and the first channel exit 3115 are perpendicular to the channel plate 311. The first connecting port 3114 is located at a top surface of the channel plate 311. In a case that the channel plate 311 is connected with the first print head 27, the first connecting port 3114 is connected with the first vent 273. Moreover, the first channel exit 3115 is located at a bottom surface of the channel plate 311.

Similarly, the second transfer channels 3112 are located beside the first transfer channels 3111 and parallel with the channel plate 311. Each of the second transfer channels 3112 comprises a second connecting port 3116 corresponding to the second vent and a second channel exit 3117. The second connecting port 3116 and the second channel exit 3117 are perpendicular to the channel plate 311. The second connecting port 3116 is located at the top surface of the channel plate 311. In a case that the channel plate 311 is connected with the second print head 28, the second connecting port 3116 is connected with the second vent. Moreover, the second channel exit 3117 is located at the bottom surface of the channel plate 311. Similarly, the third transfer channels 3113 are located beside the second transfer channels 3112 and parallel with the channel plate 311. Each of the third transfer channels 3113 comprises a third connecting port 3118 corresponding to the third vent and a third channel exit 3119. The third connecting port 3118 and the third channel exit 3119 are perpendicular to the channel plate 311. The third connecting port 3118 is located at the top surface of the channel plate 311. In a case that the channel plate 311 is connected with the third print head 29, the third connecting port 3118 is connected with the third vent. Moreover, the third channel exit 3119 is located at the bottom surface of the channel plate 311.

It is noted that the first transfer channels 3111, the second transfer channels 3112 and the third transfer channels 3113 are formed within the channel plate 311 and isolated from the surroundings. On the other hand, the first transfer channels 3111 are in communication with the surroundings through the first connecting ports 3114 and the first channel exits 3115; the second transfer channels 3112 are in communication with the surroundings through the second connecting ports 3116 and the second channel exits 3117; and the third transfer channels 3113 are in communication with the surroundings through the third connecting ports 3118 and the third channel exits 3119. Moreover, the first transfer channels 3111, the second transfer channels 3112 and the third transfer channels 3113 as shown in FIGS. 5 and 6 are all exposed to the bottom surface of the channel plate 311 in order for clearly illustrating the first transfer channels 3111, the second transfer channels 3112 and the third transfer channels 3113. In practice, the first transfer channels 3111, the second transfer channels 3112 and the third transfer channels 3113 are not exposed outside the channel plate 311. In this embodiment, the channel plate 311 comprises two first transfer channels 3111 corresponding to the first print head 27, two second transfer channels 3112 corresponding to the second print head 28 and two third transfer channels 3113 corresponding to the third print head 29. Alternatively, in some other embodiments, the channel plate 311 comprises one first transfer channel 3111 corresponding to the first print head 27, one second transfer channel 3112 corresponding to the second print head 28 and one third transfer channel 3113 corresponding to the third print head 29.

The carrier 312 is used for supporting the first switching module 317 thereon. The covering member 313 is disposed under the first channel exits 3115, the second channel exits 3117 and the third channel exits 3119, and partially sheltered by the first switching module 317. The covering member 313 comprises plural openings 3131 corresponding to the first channel exits 3115, the second channel exits 3117 and the third channel exits 3119. A first end of the exhaust pipe 314 is connected with the covering member 313, and disposed under the first channel exits 3115, the second channel exits 3117 and the third channel exits 3119. That is, the first end of the exhaust pipe 314 is located near the first channel exits 3115, the second channel exits 3117 and the third channel exits 3119. A second end of the exhaust pipe 314 is connected with the first inlet 3052 of the coupling element 305. In a case that the first transfer channels 3111, the second transfer channels 3112 and the third transfer channels 3113 are in the open status, the air within the first ink chamber 271, the second ink chamber or the third chamber may be transferred through the exhaust pipe 314. The swinging seat 316 is disposed on a housing 330 of the nozzle cleaning mechanism 33, disposed under the carrier 312, and contacted with the carrier 312. By swinging the swinging seat 316, the carrier 312 may be moved upwardly or downwardly. In a case that the carrier 312 is moved upwardly, the channel plate 311 of the ink refill mechanism 31 is connected with the first vents 273, the second vents and the third vents. In a case that the carrier 312 is moved downwardly, the channel plate 311 of the ink refill mechanism 31 is detached from the first vents 273, the second vents and the third vents.

The first switching module 317 is connected with the first channel exits 3115, the second channel exits 3117 and the third channel exits 3119 for controlling open/close statuses of the first transfer channels 3111, the second transfer channels 3112 and the third transfer channels 3113. The first switching module 317 comprises a first casing 320, a first gate mechanism 321, a second gate mechanism 322, a third gate mechanism 323, and a changeover switch 324. The first gate mechanism 321, the second gate mechanism 322 and the third gate mechanism 323 are partially enclosed by the first casing 320. The changeover switch 324 is disposed on the first casing 320, and located beside the first gate mechanism 321, the second gate mechanism 322 and the third gate mechanism 323. The changeover switch 324 is selectively contacted with the first gate mechanism 321, the second gate mechanism 322 or the third gate mechanism 323 in order to drive the first gate mechanism 321, the second gate mechanism 322 or the third gate mechanism 323. The changeover switch 324 comprises a rotating part 3241 and a pushing bulge 3242. The rotating part 3241 is disposed on the first casing 320 and rotatable relative to the first casing 320. The pushing bulge 3242 is disposed on an inner surface of the rotating part 3241. As the rotating part 3241 is rotated, the first gate mechanism 321, the second gate mechanism 322 or the third gate mechanism 323 is pushed by the pushing bulge 3242. In this embodiment, the rotating part 3241 is a gear. In addition, the rotating part 3241 is integrally formed with the pushing bulge 3242. Alternatively, in some other embodiments, the rotating part 3241 is a belt pulley.

Figure 7:
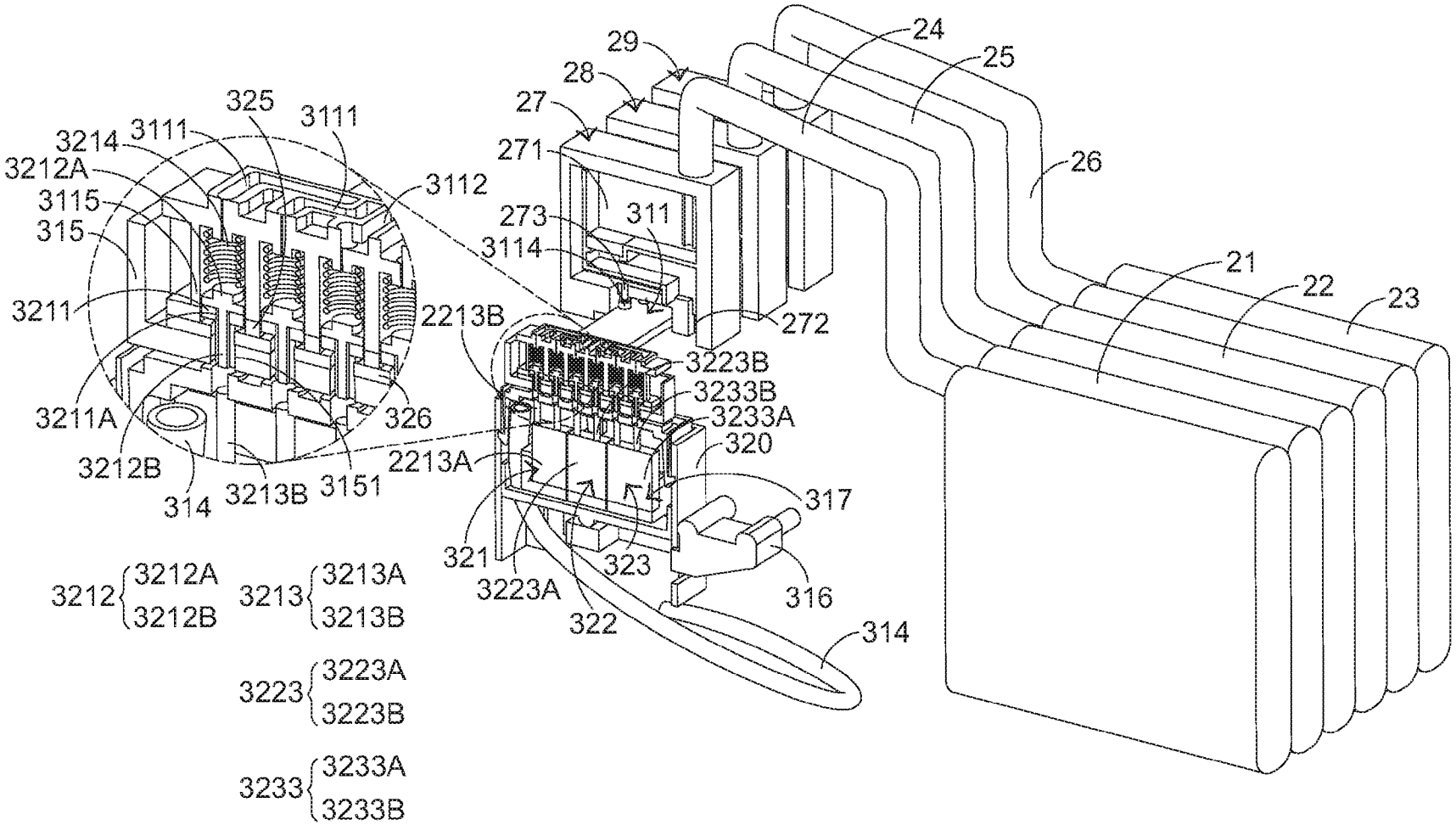
FIG. 7 is a schematic cutaway view illustrating a portion of the ink refill mechanism of the inkjet printing device according to the embodiment of the present invention.

FIG. 7 is a schematic cutaway view illustrating a portion of the ink refill mechanism of the inkjet printing device according to the embodiment of the present invention. Please refer to FIGS. 5, 6 and 7. The first gate mechanism 321 is penetrated through the plural openings 3131 and inserted into the first channel exit 3115. The first gate mechanism 321 is used for selectively unblocking or blocking the first channel exit 3115. When the first channel exit 3115 is unblocked, the first transfer channel 3111 is in the open status. When the first channel exit 3115 is blocked, the first transfer channel 3111 is in the close status. The first gate mechanism 321 comprises a first sealing element 3211, a first contact post 3212, a first pushing element 3213, and a first elastic element 3214. The first sealing element 3211 is disposed within the first channel exit 3115. In addition, the first sealing element 3211 has a first hole 3211A. The first elastic element 3214 is disposed within the first channel exit 3115 and contacted with a first end of the first contact post 3212. The first elastic element 3214 is used for providing a first elastic force to the first contact post 3212. In response to the first elastic force, the first channel exit 3115 is blocked by the first contact post 3212. In this embodiment, the first sealing element 3211 is a rubbery ring, and the first elastic element 3214 is a helical spring. The two ends of the first contact post 3212 are inserted into the first channel exit 3115 and the first hole 3211A, respectively. In addition, the first contact post 3212 is movable upwardly or downwardly relative to the first channel exit 3115. In this embodiment, the first contact post 3212 comprises a first contact part 3212A and a first notch part 3212B.

The first contact part 3212A is located at a first end of the first contact post 3212, and inserted into the first channel exit 3115. In addition, a first surface of the first contact part 3212A is contacted with the first elastic element 3214. In a case that a second surface of the first contact part 3212A is contacted with the first sealing element 3211, the first hole 3211A is covered by the first contact part 3212A, so that the first channel exit 3115 is blocked. Moreover, like the first hole 3211A, the first contact part 3212A also has a circular profile. Since the diameter of the first contact part 3212A is slightly larger than the diameter of the first hole 3211A, the first hole 3211A may be covered by the first contact part 3212A. The first notch part 3212B is located at a second end of the first contact post 3212 and inserted into the first hole 3211A in order to be contacted with the first pushing element 3213. In this embodiment, the first notch part 3212B has a cruciform profile and is composed of plural notches. Preferably, the first contact part 3212A and the first notch part 3212B are integrally formed with each other.

Please refer to FIGS. 5 and 7 again. The first pushing element 3213 is disposed under the first notch part 3212B of the first contact post 3212. Moreover, the first pushing element 3213 is movable upwardly or downwardly relative to the first channel exit 3115. In a case that the first pushing element 3213 is pushed by the pushing bulge 3242 of the changeover switch 324, the first pushing element 3213 is correspondingly moved to push the first contact post 3212. Consequently, the first channel exit 3115 is unblocked. In this embodiment, the first pushing element 3213 comprises a first pushing part 3213A and a first thimble 3213B. The first pushing part 3213A is located beside the changeover switch 324. In a case that the first pushing element 3213 is pushed by the pushing bulge 3242 of the changeover switch 324, the first pushing part 3213A is moved upwardly relative to the first channel exit 3115. In this embodiment, the first pushing part 3213A comprises a first protrusion 3213C. The first protrusion 3213C is protruded from a sidewall of the first pushing part 3213A, and located near the pushing bulge 3242. In a case that the first protrusion 3213C is pushed by the pushing bulge 3242, the first pushing part 3213A is moved upwardly relative to the first channel exit 3115. The first thimble 3213B is disposed on the first pushing part 3213A, and contacted with the first notch part 3212B of the first contact post 3212. In a case that the first pushing part 3213A is pushed by the pushing bulge 3242, the first thimble 3213B is correspondingly moved to push the first notch part 3212B. Consequently, the first notch part 3212B is moved upwardly relative to the first hole 3211A, and plural first gaps are formed between the first notch part 3212B and the first hole 3211A. Under this circumstance, the first channel exit 3115 is unblocked. Moreover, in this embodiment, the first pushing part 3213A and the first thimble 3213B are integrally formed with each other.

Similarly, the second gate mechanism 322 is penetrated through the plural openings 3131 and inserted into the second channel exit 3117. The second gate mechanism 322 is used for selectively unblocking or blocking the second channel exit 3117. When the second channel exit 3117 is unblocked, the second transfer channel 3112 is in the open status. When the second channel exit 3117 is blocked, the second transfer channel 3112 is in the close status. The second gate mechanism 322 comprises a second sealing element 3221, a second contact post 3222, a second pushing element 3223, and a second elastic element 3224. The second sealing element 3221 is disposed within the second channel exit 3117. In addition, the second sealing element 3221 has a second hole 3221A. The second elastic element 3224 is disposed within the second channel exit 3117 and contacted with a first end of the second contact post 3222. The second elastic element 3224 is used for providing a second elastic force to the second contact post 3222. In response to the second elastic force, the second channel exit 3117 is blocked by the second contact post 3222. In this embodiment, the second sealing element 3221 is a rubbery ring, and the second elastic element 3224 is a helical spring. The two ends of the second contact post 3222 are inserted into the second channel exit 3117 and the second hole 3221A, respectively. In addition, the second contact post 3222 is movable upwardly or downwardly relative to the second channel exit 3117. In this embodiment, the second contact post 3222 comprises a second contact part 3222A and a second notch part 3222B.

The second contact part 3222A is located at a first end of the second contact post 3222, and inserted into the second channel exit 3117. In addition, a first surface of the second contact part 3222A is contacted with the second elastic element 3224. In a case that a second surface of the second contact part 3222A is contacted with the second sealing element 3221, the second hole 3221A is covered by the second contact part 3222A, so that the second channel exit 3117 is blocked. Moreover, like the second hole 3221A, the second contact part 3222A also has a circular profile. Since the diameter of the second contact part 3222A is slightly larger than the diameter of the second hole 3221A, the second hole 3221A may be covered by the second contact part 3222A. The second notch part 3222B is located at a second end of the second contact post 3222 and inserted into the second hole 3221A in order to be contacted with the second pushing element 3223. In this embodiment, the second notch part 3222B has a cruciform profile and is composed of plural notches. Preferably, the second contact part 3222A and the second notch part 3222B are integrally formed with each other.

Please refer to FIGS. 5 and 7 again. The second pushing element 3223 is disposed under the second notch part 3222B of the second contact post 3222. Moreover, the second pushing element 3223 is movable upwardly or downwardly relative to the second channel exit 3117. In a case that the second pushing element 3223 is pushed by the pushing bulge 3242 of the changeover switch 324, the second pushing element 3223 is correspondingly moved to push the second contact post 3222. Consequently, the second channel exit 3117 is unblocked. In this embodiment, the second pushing element 3223 comprises a second pushing part 3223A and a second thimble 3223B. The second pushing part 3223A is located beside the changeover switch 324. In a case that the second pushing element 3223 is pushed by the pushing bulge 3242 of the changeover switch 324, the second pushing part 3223A is moved upwardly relative to the second channel exit 3117. In this embodiment, the second pushing part 3223A comprises a second protrusion 3223C. The second protrusion 3223C is protruded from a sidewall of the second pushing part 3223A, and located near the pushing bulge 3242. In a case that the second protrusion 3223C is pushed by the pushing bulge 3242, the second pushing part 3223A is moved upwardly relative to the second channel exit 3117. The second thimble 3223B is disposed on the second pushing part 3223A, and contacted with the second notch part 3222B of the second contact post 3222. In a case that the second pushing part 3223A is pushed by the pushing bulge 3242, the second thimble 3223B is correspondingly moved to push the second notch part 3222B. Consequently, the second notch part 3222B is moved upwardly relative to the second hole 3221A, and plural second gaps are formed between the second notch part 3222B and the second hole 3221A. Under this circumstance, the second channel exit 3117 is unblocked. Moreover, in this embodiment, the second pushing part 3223A and the second thimble 3223B are integrally formed with each other.

Similarly, the third gate mechanism 323 is penetrated through the plural openings 3131 and inserted into the third channel exit 3119. The third gate mechanism 323 is used for selectively unblocking or blocking the third channel exit 3119. When the third channel exit 3119 is unblocked, the third transfer channel 3113 is in the open status. When the third channel exit 3119 is blocked, the third transfer channel 3113 is in the close status. The third gate mechanism 323 comprises a third sealing element 3231, a third contact post 3232, a third pushing element 3233, and a third elastic element 3234. The third sealing element 3231 is disposed within the third channel exit 3119. In addition, the third sealing element 3231 has a third hole 3231A. The third elastic element 3234 is disposed within the third channel exit 3119 and contacted with a first end of the third contact post 3232. The third elastic element 3234 is used for providing a third elastic force to the third contact post 3232. In response to the third elastic force, the third channel exit 3119 is blocked by the third contact post 3232. In this embodiment, the third sealing element 3231 is a rubbery ring, and the third elastic element 3234 is a helical spring. The two ends of the third contact post 3232 are inserted into the third channel exit 3119 and the third hole 3231A, respectively. In addition, the third contact post 3232 is movable upwardly or downwardly relative to the third channel exit 3119. In this embodiment, the third contact post 3232 comprises a third contact part 3232A and a third notch part 3232B.

The third contact part 3232A is located at a first end of the third contact post 3232, and inserted into the third channel exit 3119. In addition, a first surface of the third contact part 3232A is contacted with the third elastic element 3234. In a case that a second surface of the third contact part 3232A is contacted with the third sealing element 3231, the third hole 3231A is covered by the third contact part 3232A, so that the third channel exit 3119 is blocked. Moreover, like the third hole 3231A, the third contact part 3232A also has a circular profile. Since the diameter of the third contact part 3232A is slightly larger than the diameter of the third hole 3231A, the third hole 3231A may be covered by the third contact part 3232A. The third notch part 3232B is located at a second end of the third contact post 3232 and inserted into the third hole 3231A in order to be contacted with the third pushing element 3233. In this embodiment, the third notch part 3232B has a cruciform profile and is composed of plural notches. Preferably, the third contact part 3232A and the third notch part 3232B are integrally formed with each other.

Please refer to FIGS. 5 and 7 again. Please refer to FIGS. 5 and 7 again. The third pushing element 3233 is disposed under the third notch part 3232B of the third contact post 3232. Moreover, the third pushing element 3233 is movable upwardly or downwardly relative to the third channel exit 3119. In a case that the third pushing element 3233 is pushed by the pushing bulge 3242 of the changeover switch 324, the third pushing element 3233 is correspondingly moved to push the third contact post 3232. Consequently, the third channel exit 3119 is unblocked. In this embodiment, the third pushing element 3233 comprises a third pushing part 3233A and a third thimble 3233B. The third pushing part 3233A is located beside the changeover switch 324. In a case that the third pushing element 3233 is pushed by the pushing bulge 3242 of the changeover switch 324, the third pushing part 3233A is moved upwardly relative to the third channel exit 3119. In this embodiment, the third pushing part 3233A comprises a third protrusion 3233C. The third protrusion 3233C is protruded from a sidewall of the third pushing part 3233A, and located near the pushing bulge 3242. In a case that the third protrusion 3233C is pushed by the pushing bulge 3242, the third pushing part 3233A is moved upwardly relative to the third channel exit 3119. The third thimble 3233B is disposed on the third pushing part 3233A, and contacted with the third notch part 3232B of the third contact post 3232. In a case that the third pushing part 3233A is pushed by the pushing bulge 3242, the third thimble 3233B is correspondingly moved to push the third notch part 3232B. Consequently, the third notch part 3232B is moved upwardly relative to the third hole 3231A, and plural third gaps are formed between the third notch part 3232B and the third hole 3231A. Under this circumstance, the third channel exit 3119 is unblocked. Moreover, in this embodiment, the third pushing part 3233A and the third thimble 3233B are integrally formed with each other.

Please refer to FIGS. 5, 6 and 7 again. The first switching module 317 further comprises a sealing plate 325 and a supporting frame 326. The sealing plate 325 comprises plural sealing plate apertures 3251 corresponding to the first channel exits 3115, the second channel exits 3117 and the third channel exits 3119. Consequently, the first channel exits 3115, the second channel exits 3117 and the third channel exits 3119 run through corresponding sealing plate apertures 3251. In addition, the sealing plate 325 is contacted with the first sealing element 3211, the second sealing element 3221 and the third sealing element 3231 in order to prevent leakage of the first ink, the second ink and the third ink from the first channel exits 3115, the second channel exits 3117 and the third channel exits 3119. The supporting frame 326 is disposed under the sealing plate 325. In addition, the supporting frame 326 comprises plural supporting frame apertures 3261 corresponding to respective sealing plate apertures 3251. The supporting frame 326 is used for supporting the first sealing elements 3211, the second sealing elements 3221 and the third sealing elements 3231 in order to prevent detachment of the first contact posts 3212, the second contact posts 3222 and the third contact posts 3232 from the first channel exits 3115, the second channel exits 3117 and the third channel exits 3119. As shown in FIG. 7, the protective cover 315 is arranged between the supporting frame 326 and the covering member 313 for protecting the first channel exits 3115, the second channel exits 3117 and the third channel exits 3119. Moreover, the protective cover 315 comprises plural protective cover apertures 3151 corresponding to the first contact posts 3212, the second contact posts 3222 and the third contact posts 3232. Consequently, after the first contact posts 3212, the second contact posts 3222 and the third contact posts 3232 are penetrated through respective protective cover apertures 3151, the first contact posts 3212, the second contact posts 3222 and the third contact posts 3232 are inserted into the first channel exits 3115, the second channel exits 3117 and the third channel exits 3119, respectively.

The ink refill mechanism 31 further comprises an ink detecting member (not shown) and a driving member (not shown). The ink detecting member is used for detecting the amount of ink contained in the first ink chamber 271, the second ink chamber and the third ink chamber. Moreover, in a case that the ink within the first ink chamber 271, the second ink chamber or the third ink chamber is used up, the driving member is activated. The driving member is connected with the swinging seat 316 and the first switching module 317. The driving member is used for driving the swinging seat 316 to allow the ink refill mechanism 31 to be connected with the first print head 27, the second print head 28 and the third print head 29. Alternatively, the driving member is used for driving the changeover switch 324, thereby enabling the ink refill mechanism 31. In this embodiment, the driving member comprises a motor and a gear set. In some other embodiments, the driving member comprises a motor and a belt pulley assembly.

Figure 8:
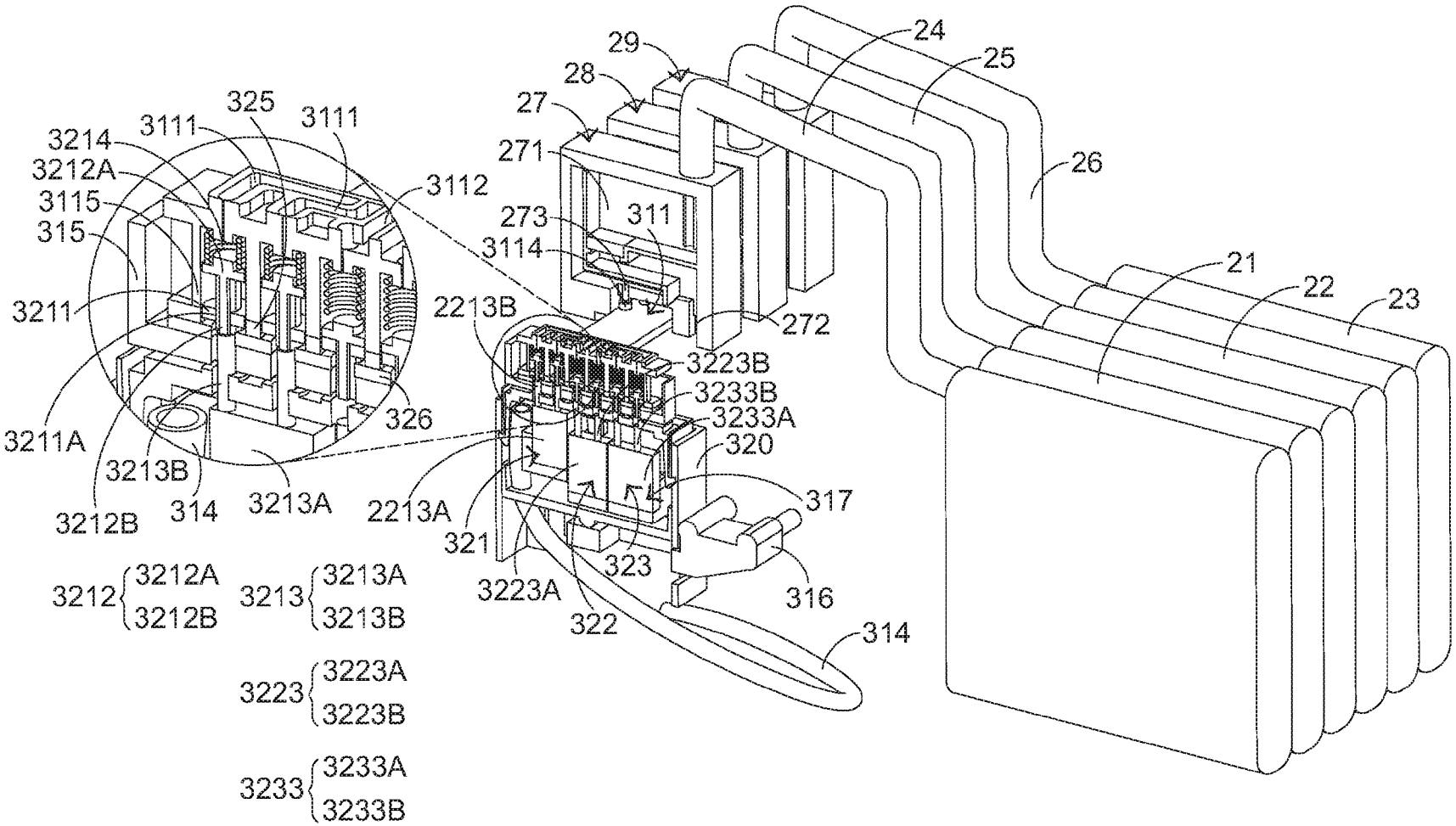
FIG. 8 is a schematic cutaway view illustrating a portion of the ink refill mechanism of the inkjet printing device according to the embodiment of the present invention, in which the first gate mechanism is enabled.

Hereinafter, the operations of the ink refill mechanism 31 will be illustrated with reference to FIGS. 3 and 8. FIG. 8 is a schematic cutaway view illustrating a portion of the ink refill mechanism of the inkjet printing device according to the embodiment of the present invention, in which the first gate mechanism is enabled. In a case that the first ink within the first ink chamber 271 is used up, the space within the first ink chamber 271 is full of air. Under this circumstance, the ink-refilling task fails to be performed. Then, the swinging seat 316 is driven by the driving member to be swung. As the swinging seat 316 is swung, the carrier 312 is moved upwardly, and the channel plate 311 is connected with the first vents 273, the second vents and the third vents. Meanwhile, the first connecting ports 3114 of the channel plate 311 are connected with the first vents 273 of the first print head 27; the second connecting ports 3116 of the channel plate 311 are connected with the second vents of the second print head 28; and the third connecting ports 3118 of the channel plate 311 are connected with the third vents of the third print head 29. Under this circumstance, the first ink chamber 271 is in communication with the first transfer channels 3111 through the first connecting ports 3114 and the first vents 273; the second ink chamber is in communication with the second transfer channels 3112 through the second connecting ports 3116 and the second vents; and the third ink chamber is in communication with the third transfer channels 3113 through the third connecting ports 3118 and the third vents. On the other hand, the first channel exits 3115 are blocked by the first gate mechanism 321, the second channel exits 3117 are blocked by the second gate mechanism 322, and the third channel exits 3119 are blocked by the third gate mechanism 323. That is, the first transfer channels 3111, the second transfer channels 3112 and the third transfer channels 3113 are all in the close status.

After the changeover switch 324 is enabled, the rotating part 3241 of the changeover switch 324 is rotated and the first protrusion 3213C of the first pushing part 3213A is pushed by the pushing bulge 3242. Consequently, the first pushing part 3213A is moved upwardly relative to the first channel exit 3115, and the first notch part 3212B of the first contact post 3212 over the first thimble 3213B is pushed by the first thimble 3213B. Meanwhile, since the pushing force provided by the first thimble 3213B is larger than the first elastic force provided by the first elastic element 3214, the first contact post 3212 may be moved upwardly relative to the first channel exit 3115. Consequently, the first contact part 3212A of the first contact post 3212 is separated from the first sealing element 3211 without covering the first hole 3211A, and plural first gaps are formed between the first notch part 3212B and the first hole 3211A. Under this circumstance, the first channel exit 3115 is unblocked.

After the first channel exit 3115 is unblocked, the first transfer channel 3111 is in communication with the exhaust pipe 314, the coupling element 305, the suction pipe 302 and the power pump 301. Consequently, the first transfer channel 3111 is in the open status. In response to the suction force generated by the power pump 301, the air is sequentially transferred through the first vent 273, the first connecting port 3114, the first transfer channel 3111, the first channel exit 3115, the exhaust pipe 314, the first inlet 3052 and the outlet 3051, and delivered to the suction pipe 302. After the air is vented by the power pump 301, the pressure within the first ink chamber 271 is changed. Consequently, the first ink within the first ink cartridge 21 is transferred to the first ink chamber 271 through the first ink pipe 24. Meanwhile, the ink-refilling task of the first ink chamber 271 can be performed. After the ink-refilling task of the first ink chamber 271 is completed, the rotating part 3241 is continuously rotated, and thus the first protrusion 3213C is no longer pushed by the pushing bulge 3242. Consequently, the first pushing part 3213A is moved downwardly relative to the first channel exit 3115 and returned to the original position. As the first pushing part 3213A is moved downwardly, the first contact post 3212 is moved downwardly relative to the first channel exit 3115. Until the first hole 3211A is covered by the first contact part 3212A again, the first channel exit 3115 is blocked. After the ink-refilling task of the first ink chamber 271 is completed, the first print head 27 can eject the first ink again in order to perform an inkjet printing task.

Figure 9:
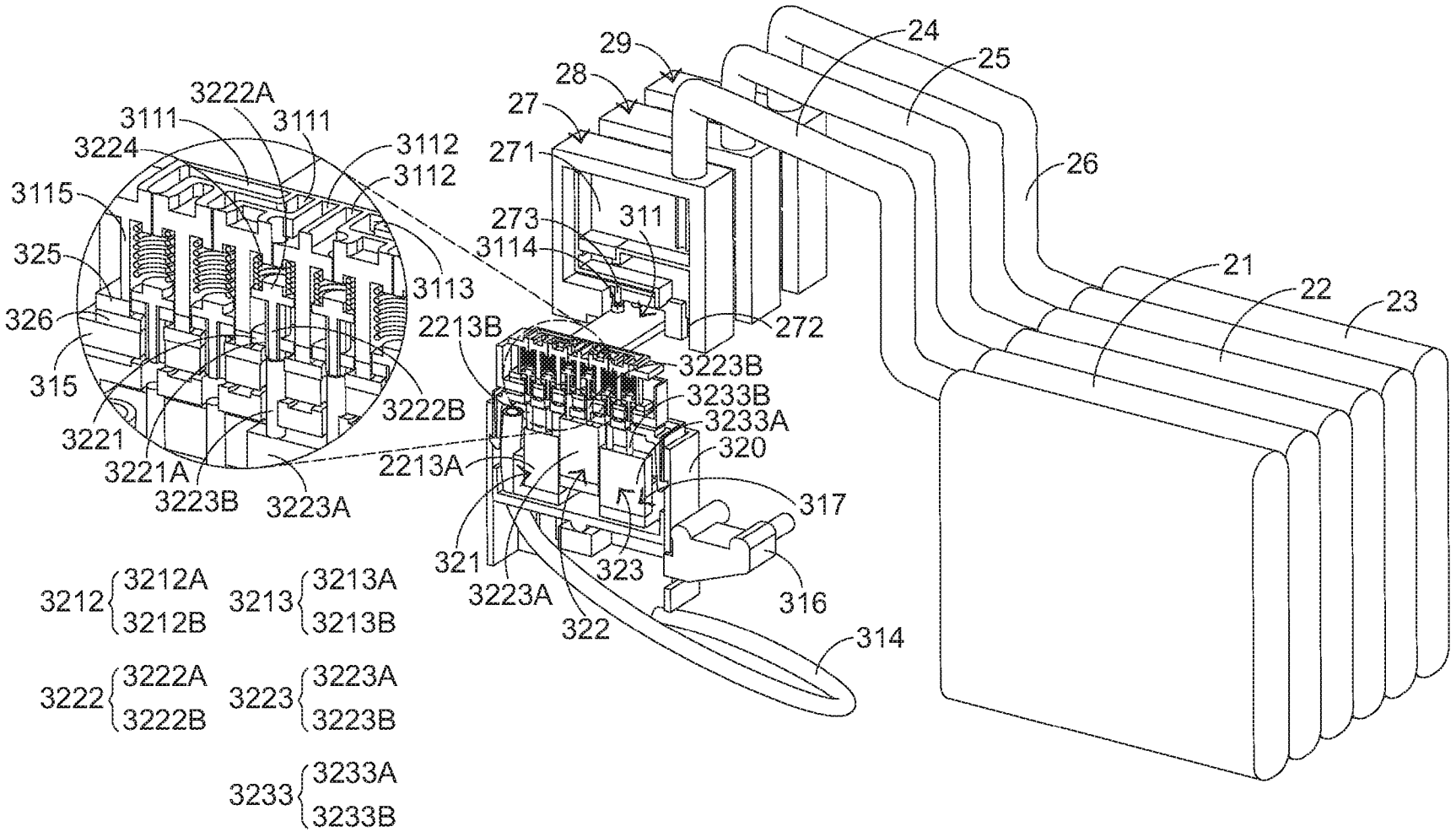
FIG. 9 is a schematic cutaway view illustrating a portion of the ink refill mechanism of the inkjet printing device according to the embodiment of the present invention, in which the second gate mechanism is enabled.

FIG. 9 is a schematic cutaway view illustrating a portion of the ink refill mechanism of the inkjet printing device according to the embodiment of the present invention, in which the second gate mechanism is enabled. Please refer to FIGS. 3 and 9. In a case that the second ink within the second ink chamber is used up, the space within the second ink chamber is full of air. Under this circumstance, the ink-refilling task fails to be performed. Then, the swinging seat 316 is driven by the driving member to be swung. As the swinging seat 316 is swung, the carrier 312 is moved upwardly, and the channel plate 311 is connected with the first vents 273, the second vents and the third vents. Meanwhile, the first connecting ports 3114 of the channel plate 311 are connected with the first vents 273 of the first print head 27; the second connecting ports 3116 of the channel plate 311 are connected with the second vents of the second print head 28; and the third connecting ports 3118 of the channel plate 311 are connected with the third vents of the third print head 29. Under this circumstance, the first ink chamber 271 is in communication with the first transfer channels 3111 through the first connecting ports 3114 and the first vents 273; the second ink chamber is in communication with the second transfer channels 3112 through the second connecting ports 3116 and the second vents; and the third ink chamber is in communication with the third transfer channels 3113 through the third connecting ports 3118 and the third vents. On the other hand, the first channel exits 3115 are blocked by the first gate mechanism 321, the second channel exits 3117 are blocked by the second gate mechanism 322, and the third channel exits 3119 are blocked by the third gate mechanism 323. That is, the first transfer channels 3111, the second transfer channels 3112 and the third transfer channels 3113 are all in the close status.

After the changeover switch 324 is enabled, the rotating part 3241 of the changeover switch 324 is rotated and the second protrusion 3223C of the second pushing part 3223A is pushed by the pushing bulge 3242. Consequently, the second pushing part 3223A is moved upwardly relative to the second channel exit 3117, and the second notch part 3222B of the second contact post 3222 over the second thimble 3223B is pushed by the second thimble 3223B. Meanwhile, since the pushing force provided by the second thimble 3223B is larger than the second elastic force provided by the second elastic element 3224, the second contact post 3222 may be moved upwardly relative to the second channel exit 3117. Consequently, the second contact part 3222A of the second contact post 3222 is separated from the second sealing element 3221 without covering the second hole 3221A, and plural second gaps are formed between the second notch part 3222B and the second hole 3221A. Under this circumstance, the second channel exit 3117 is unblocked.

After the second channel exit 3117 is unblocked, the second transfer channel 3112 is in communication with the exhaust pipe 314, the coupling element 305, the suction pipe 302 and the power pump 301. Consequently, the second transfer channel 3112 is in the open status. In response to the suction force generated by the power pump 301, the air is sequentially transferred through the second vent, the second connecting port 3116, the second transfer channel 3112, the second channel exit 3117, the exhaust pipe 314, the second inlet 3053 and the outlet 3051, and delivered to the suction pipe 302. After the air is vented by the power pump 301, the pressure within the second ink chamber is changed. Consequently, the second ink within the second ink cartridge 22 is transferred to the second ink chamber through the second ink pipe 25. Meanwhile, the ink-refilling task of the second ink chamber can be performed. After the ink-refilling task of the second ink chamber is completed, the rotating part 3241 is continuously rotated, and thus the second protrusion 3223C is no longer pushed by the pushing bulge 3242. Consequently, the second pushing part 3223A is moved downwardly relative to the second channel exit 3117 and returned to the original position. As the second pushing part 3223A is moved downwardly, the second contact post 3222 is moved downwardly relative to the second channel exit 3117. Until the second hole 3212A is covered by the second contact part 3222A again, the second channel exit 3117 is blocked. After the ink-refilling task of the second ink chamber is completed, the second print head 28 can eject the second ink again in order to perform the inkjet printing task. The way of performing the ink-refilling task of the third ink chamber is similar to the ways of performing the ink-refilling task of the first ink chamber 271 and the second ink chamber, and is not redundantly described herein.

Furthermore, in a case that the first ink within the first ink chamber 271 contains bubbles, some drawbacks may occur. For example, the presence of the bubbles may result in uneven concentration distribution of the first ink, and thus the printing quality is deteriorated. The use of the ink refill mechanism 31 is able to solve the problem of containing bubbles in the ink. When the ink refill mechanism 31 is used to remove the bubbles from the first ink, the above procedures are sequentially performed to unblock the first channel exit 3115 by simply enabling the first switching module 317. Consequently, the first transfer channel 3111 is in the open status. Meanwhile, in response to the suction force generated by the power pump 301, the bubbles are ejected out through the first vent 273, the first connecting port 3114, the first transfer channel 3111 and the first channel exit 3115 sequentially. After the bubbles are removed from the first ink, the printing quality is enhanced. The ways of using the ink refill mechanism 31 to remove the bubbles from the second ink and the third ink are similar to the way of removing the bubbles from the first ink, and are not redundantly described herein.

Figure 10:
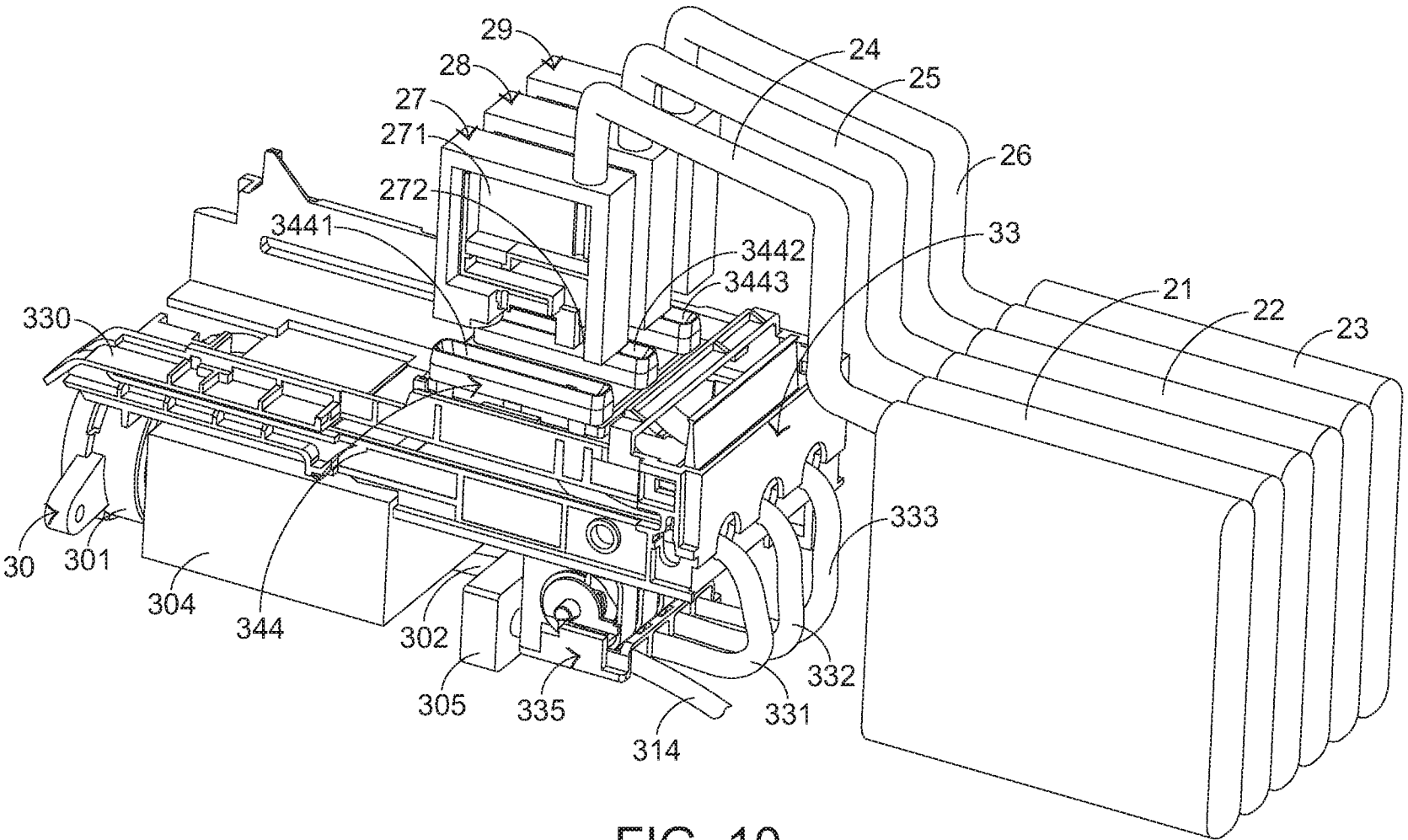
FIG. 10 is a schematic perspective view illustrating the nozzle cleaning mechanism and the pump module of the inkjet printing device according to the embodiment of the present invention.

Hereinafter, the structures of the nozzle cleaning mechanism 33 will be illustrated with reference to FIG. 10. FIG. 10 is a schematic perspective view illustrating the nozzle cleaning mechanism and the pump module of the inkjet printing device according to the embodiment of the present invention. In addition to the housing 330, the nozzle cleaning mechanism 33 further comprises a first duct 331, a second duct 332, a third duct 333, a connecting cover 334 and a second switching module 335. The connection between associated components of the nozzle cleaning mechanism 33 will be illustrated as follows. The two ends of the first duct 331 are connected with the second inlet 3053 of the coupling element 305 and the connecting cover 334, respectively. The two ends of the second duct 332 are connected with the third inlet 3054 of the coupling element 305 and the connecting cover 334, respectively. The two ends of the third duct 333 are connected with the fourth inlet 3055 of the coupling element 305 and the connecting cover 334, respectively. The second switching module 335 is located near the exhaust pipe 314 of the ink refill mechanism 31, the first duct 331, the second duct 332 and the third duct 333.

Please refer to FIG. 10 again. The connecting cover 334 is disposed under the first print head 27, the second print head 28 and the third print head 29, and connectable with the first print head 27, the second print head 28 and the third print head 29. Moreover, the connecting cover 334 comprises a first covering recess 3341, a second covering recess 3342, and a third covering recess 3343. The first covering recess 3341 is located at a top surface of the connecting cover 334 for covering the first nozzle 272 of the first print head 27. Consequently, the first ink within the first ink chamber 271 may be introduced into the first duct 331 through the first covering recess 3341. The second covering recess 3342 is located at the top surface of the connecting cover 334 and located beside the first covering recess 3341 for covering the second nozzle of the second print head 28. Consequently, the second ink within the second ink chamber may be introduced into the second duct 332 through the second covering recess 3342. The third covering recess 3343 is located at the top surface of the connecting cover 334 and located beside second covering recess 3342 for covering the third nozzle of the third print head 29. Consequently, the third ink within the third ink chamber may be introduced into the third duct 333 through the third covering recess 3343.

Furthermore, in order to connect the connecting cover 334 with the first print head 27, the second print head 28 and the third print head 29, the connecting cover 334 is moved upwardly from the position under the first print head 27, the second print head 28 and the third print head 29. Consequently, the first nozzle 272, the second nozzle and the third nozzle are covered by the first covering recess 3341, the second covering recess 3342 and the third covering recess 3343, respectively. For achieving the above purposes, the inkjet printing device 2 further comprises a transmission mechanism (not shown). The transmission mechanism is connected with the connecting cover 334. By the transmission mechanism, the connecting cover 334 may be moved upwardly to be connected with the first print head 27, the second print head 28 and the third print head 29, or the connecting cover 334 may be moved downwardly to be detached from the first print head 27, the second print head 28 and the third print head 29.

From the above discussions, the first duct 331 is in communication with the first print head 27 and the power pump 301 through the connecting cover 334 and the coupling element 305. In response to the suction force generated by the power pump 301, the first ink within the first ink chamber 271 may be transferred through the first nozzle 272 in order to eliminate the clogged condition of the first nozzle 272. After the first ink is departed from the first nozzle 271, in response to the suction force, the first ink is sequentially transferred through the first covering recess 3341, the first duct 331, the second inlet 3053 and the outlet 3051, and delivered to the suction pipe 302. Similarly, the second duct 332 is in communication with the second print head 28 and the power pump 301 through the connecting cover 334 and the coupling element 305. In response to the suction force generated by the power pump 301, the second ink within the second ink chamber may be sequentially transferred through the second nozzle, the second covering recess 3342, the second duct 332, the third inlet 3054 and the outlet 3051, and delivered to the suction pipe 302. Similarly, the third duct 333 is in communication with the third print head 29 and the power pump 301 through the connecting cover 334 and the coupling element 305. In response to the suction force generated by the power pump 301, the third ink within the third ink chamber may be sequentially transferred through the third nozzle, the third covering recess 3343, the third duct 333, the fourth inlet 3055 and the outlet 3051, and delivered to the suction pipe 302. After the first ink, the second ink and the third ink are transferred through the suction pipe 302, the first ink, the second ink and the third ink are delivered to the storage element through the discharge pipe 303. Under this circumstance, since the first ink, the second ink or the third ink is transferred through the first nozzle 272, the second nozzle or the third nozzle, the clogged condition of the first nozzle 272, the second nozzle or the third nozzle can be eliminated.

Figure 11:
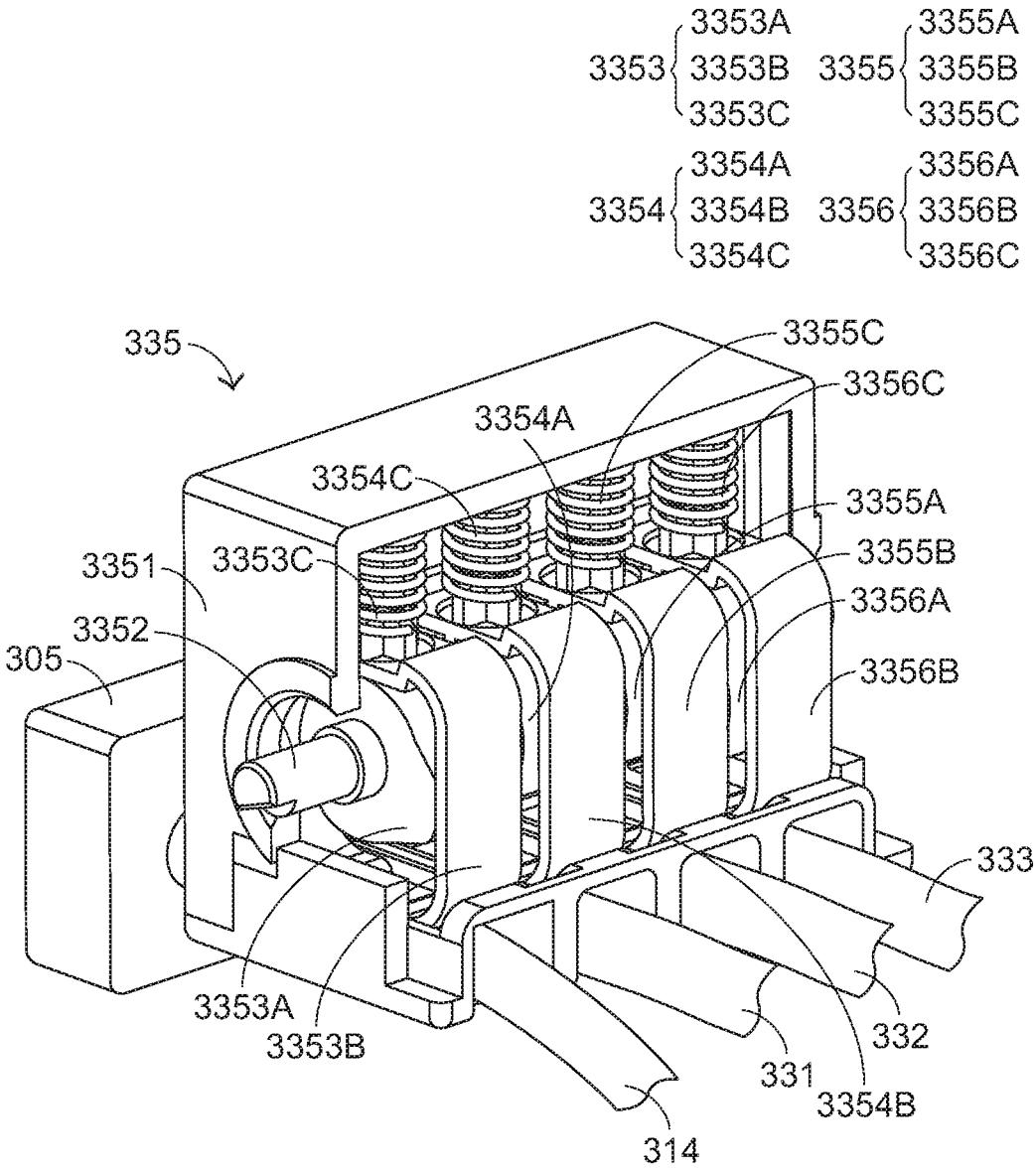
FIG. 11 is a schematic perspective view illustrating the second switching module of the nozzle cleaning mechanism of the inkjet printing device according to the embodiment of the present invention.
Figure 12:
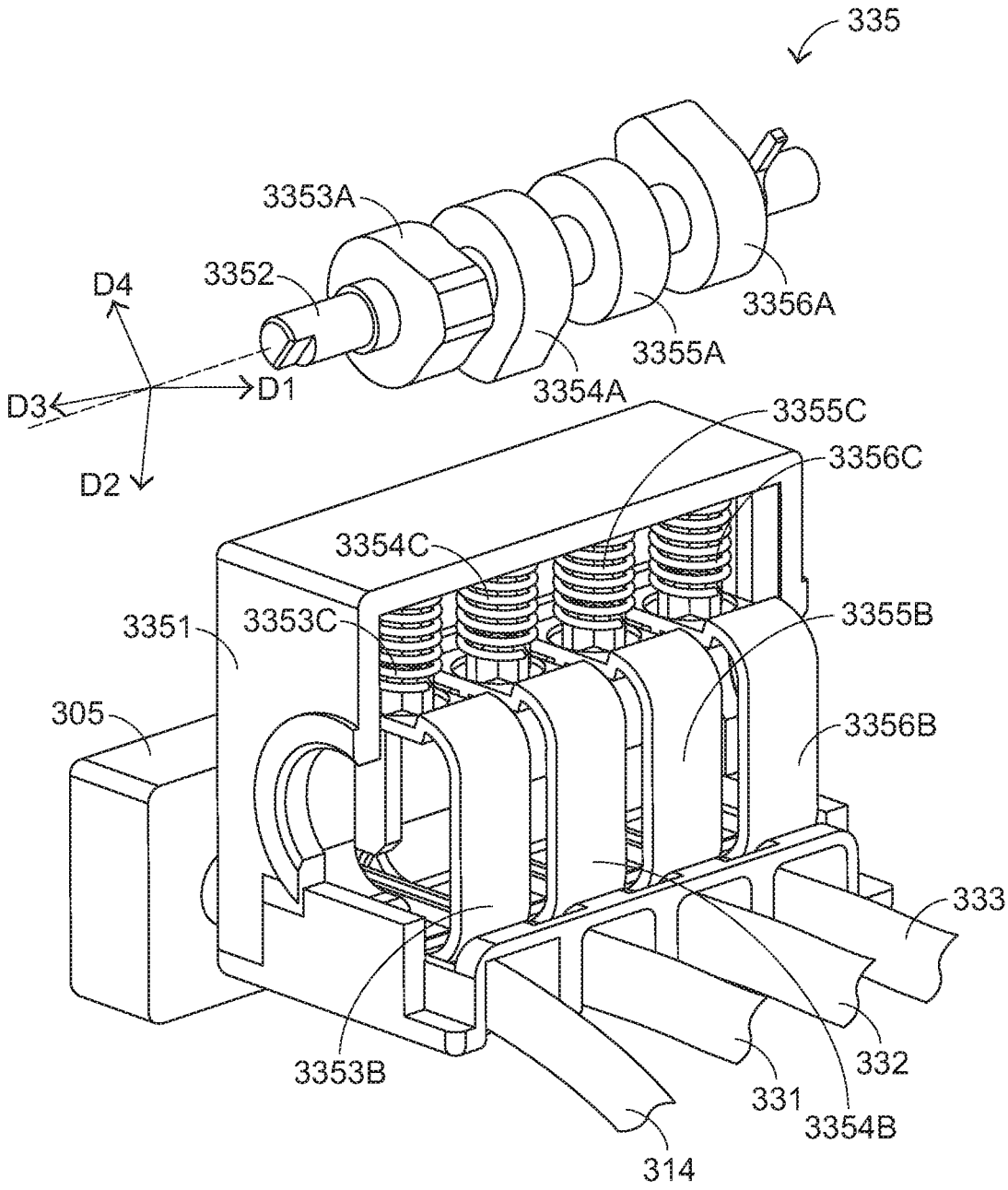
FIG. 12 is a schematic perspective view illustrating a portion of the second switching module of FIG. 11.

Hereinafter, the structures of the second switching module 335 will be illustrated with reference to FIGS. 11 and 12. FIG. 11 is a schematic perspective view illustrating the second switching module of the nozzle cleaning mechanism of the inkjet printing device according to the embodiment of the present invention. FIG. 12 is a schematic perspective view illustrating a portion of the second switching module of FIG. 11. The second switching module 335 is located near the exhaust pipe 314, the first duct 331, the second duct 332 and the third duct 333. The second switching module 335 is used for controlling the open/close statuses of the first duct 331, the second duct 332 and the third duct 333 in order to prevent the first ink, the second ink and the third ink from being simultaneously sucked in response to the suction force. As shown in FIGS. 11 and 12, the second switching module 335 comprises a second casing 3351, a rotating shaft 3352, a fourth gate mechanism 3353, a fifth gate mechanism 3354, a sixth gate mechanism 3355, and a seventh gate mechanism 3356. The rotating shaft 3352 is disposed on the second casing 3351, and rotatable relative to the second casing 3351. The fourth gate mechanism 3353 is connected with the rotating shaft 3352 and located near the exhaust pipe 314. The fourth gate mechanism 3353 is oriented along a first direction D1. As the rotating shaft 3352 is rotated, the exhaust pipe 314 is pressed by the fourth gate mechanism 3353 or separated from the fourth gate mechanism 3353, so that the exhaust pipe 314 is in a close status or an open status.

Similarly, the fifth gate mechanism 3354 is connected with the rotating shaft 3352, located beside the fourth gate mechanism 3353, and located near the first duct 331. The fifth gate mechanism 3354 is oriented along a second direction D2. As the rotating shaft 3352 is rotated, the first duct 331 is pressed by the fifth gate mechanism 3354 or separated from the fifth gate mechanism 3354, so that the first duct 331 is in the close status or the open status. Similarly, the sixth gate mechanism 3355 is connected with the rotating shaft 3352, located beside the fifth gate mechanism 3354, and located near the second duct 332. The sixth gate mechanism 3355 is oriented along a third direction D3. As the rotating shaft 3352 is rotated, the second duct 332 is pressed by the sixth gate mechanism 3355 or separated from the sixth gate mechanism 3355, so that the second duct 332 is in the close status or the open status. Similarly, the seventh gate mechanism 3356 is connected with the rotating shaft 3352, located beside the sixth gate mechanism 3355, and located near the third duct 333. The seventh gate mechanism 3356 is oriented along a fourth direction D4. As the rotating shaft 3352 is rotated, the third duct 333 is pressed by the seventh gate mechanism 3356 or separated from the seventh gate mechanism 3356, so that the third duct 333 is in the close status or the open status.

Please refer to FIGS. 11 and 12 again. The fourth gate mechanism 3353 comprises a first cam 3353A, a first contact plate 3353B, and a fourth elastic element 3353C. The first cam 3353A is disposed on the rotating shaft 3352, and located near the exhaust pipe 314. Moreover, the first cam 3353A is oriented along the first direction D1. The first cam 3353A is rotated with the rotating shaft 3352. The first contact plate 3353B is disposed around the first cam 3353A and the rotating shaft 3352. In a case that the first contact plate 3353B is not pushed by the first cam 3353A, the exhaust pipe 314 is pressed by the first contact plate 3353B, and thus the exhaust pipe 314 is in the close status. In a case that the first cam 3353A is rotated with the rotating shaft 3352 and the first contact plate 3353B is pushed by the first cam 3353A, the first contact plate 3353B is moved relative to the second casing 3351 and separated from the exhaust pipe 314, and thus the exhaust pipe 314 is in the open status. The fourth elastic element 3353C is arranged between the second casing 3351 and the first contact plate 3353B, and contacted with the second casing 3351 and the first contact plate 3353B. The fourth elastic element 3353C is used for providing a fourth elastic force to the first contact plate 3353B. In a case that the first contact plate 3353B is not pushed by the first cam 3353A, in response to the fourth elastic force, the first contact plate 3353B is moved relative to the second casing 3351 to press the exhaust pipe 314 and the exhaust pipe 314 is restored to the close status.

Similarly, the fifth gate mechanism 3354 comprises a second cam 3354A, a second contact plate 3354B, and a fifth elastic element 3354C. The second cam 3354A is disposed on the rotating shaft 3352, and located near the first duct 331. Moreover, the second cam 3354A is oriented along the second direction D2. The second cam 3354A is rotated with the rotating shaft 3352. The second contact plate 3354B is disposed around the second cam 3354A and the rotating shaft 3352. In a case that the second contact plate 3354B is not pushed by the second cam 3354A, the first duct 331 is pressed by the second contact plate 3354B, and thus the first duct 331 is in the close status. In a case that the second cam 3354A is rotated with the rotating shaft 3352 and the second contact plate 3354B is pushed by the second cam 3354A, the second contact plate 3354B is moved relative to the second casing 3351 and separated from the first duct 331, and thus the first duct 331 is in the open status. The fifth elastic element 3354C is arranged between the second casing 3351 and the second contact plate 3354B, and contacted with the second casing 3351 and the second contact plate 3354B. The fifth elastic element 3354C is used for providing a fifth elastic force to the second contact plate 3354B. In a case that the second contact plate 3354B is not pushed by the second cam 3354A, in response to the fifth elastic force, the second contact plate 3354B is moved relative to the second casing 3351 to press the first duct 331 and the first duct 331 is restored to the close status.

Similarly, the sixth gate mechanism 3355 comprises a third cam 3355A, a third contact plate 3355B, and a sixth elastic element 3355C. The third cam 3355A is disposed on the rotating shaft 3352, and located near the second duct 332. Moreover, the third cam 3355A is oriented along the third direction D3. The third cam 3355A is rotated with the rotating shaft 3352. The third contact plate 3355B is disposed around the third cam 3355A and the rotating shaft 3352. In a case that the third contact plate 3355B is not pushed by the third cam 3355A, the second duct 332 is pressed by the third contact plate 3355B, and thus the second duct 332 is in the close status. In a case that the third cam 3355A is rotated with the rotating shaft 3352 and the third contact plate 3355B is pushed by the third cam 3355A, the third contact plate 3355B is moved relative to the second casing 3351 and separated from the second duct 332, and thus the second duct 332 is in the open status. The sixth elastic element 3355C is arranged between the second casing 3351 and the third contact plate 3355B, and contacted with the second casing 3351 and the third contact plate 3355B. The sixth elastic element 3355C is used for providing a sixth elastic force to the third contact plate 3355B. In a case that the third contact plate 3355B is not pushed by the third cam 3355A, in response to the sixth elastic force, the third contact plate 3355B is moved relative to the second casing 3351 to press the second duct 332 and the second duct 332 is restored to the close status.

Similarly, the seventh gate mechanism 3356 comprises a fourth cam 3356A, a fourth contact plate 3356B, and a seventh elastic element 3356C. The fourth cam 3356A is disposed on the rotating shaft 3352, and located near the third duct 333. Moreover, the fourth cam 3356A is oriented along the fourth direction D4. The fourth cam 3356A is rotated with the rotating shaft 3352. The fourth contact plate 3356B is disposed around the fourth cam 3356A and the rotating shaft 3352. In a case that the fourth contact plate 3356B is not pushed by the fourth cam 3356A, the third duct 333 is pressed by the fourth contact plate 3356B, and thus the third duct 333 is in the close status. In a case that the fourth cam 3356A is rotated with the rotating shaft 3352 and the fourth contact plate 3356B is pushed by the fourth cam 3356A, the fourth contact plate 3356B is moved relative to the second casing 3351 and separated from the third duct 333, and thus the third duct 333 is in the open status. The seventh elastic element 3356C is arranged between the second casing 3351 and the fourth contact plate 3356B, and contacted with the second casing 3351 and the fourth contact plate 3356B. The seventh elastic element 3356C is used for providing a seventh elastic force to the fourth contact plate 3356B. In a case that the fourth contact plate 3356B is not pushed by the fourth cam 3356A, in response to the seventh elastic force, the fourth contact plate 3356B is moved relative to the second casing 3351 to press the third duct 333 and the third duct 333 is restored to the close status.

In this embodiment, the fourth elastic element 3353C, the fifth elastic element 3354C, the sixth elastic element 3355C and the seventh elastic element 3356C are all helical springs.

As shown FIG. 12, the first cam 3353A, the second cam 3354A, the third cam 3355A and the fourth cam 3356A are arranged side by side, and disposed on the rotating shaft 3352 in a staggered form. The first cam 3353A is oriented along the first direction D1. The second cam 3354A is oriented along the second direction D2. The third cam 3355A is oriented along the third direction D3. The fourth cam 3356A is oriented along the fourth direction D4. There is a first included angle between the first direction D1 and the second direction D2. There is a second included angle between the second direction D2 and the third direction D3. There is a third included angle between the third direction D3 and the fourth direction D4. It is noted that the first included angle, the second included angle and the third included angle may be varied according to the practical requirements.

The inkjet printing device 2 further comprises an additional driving member (not shown) and a sensor (not shown). The additional driving member is connected with the rotating shaft 3352. As the additional driving member is rotated, the rotating shaft 3352 is driven to be rotated. The sensor is located near the rotating shaft 3352 for detecting the rotating position of the rotating shaft 3352, thereby judging the operating statuses of the fourth gate mechanism 3353, the fifth gate mechanism 3354, the sixth gate mechanism 3355 and the seventh gate mechanism 3356.

Figure 13:
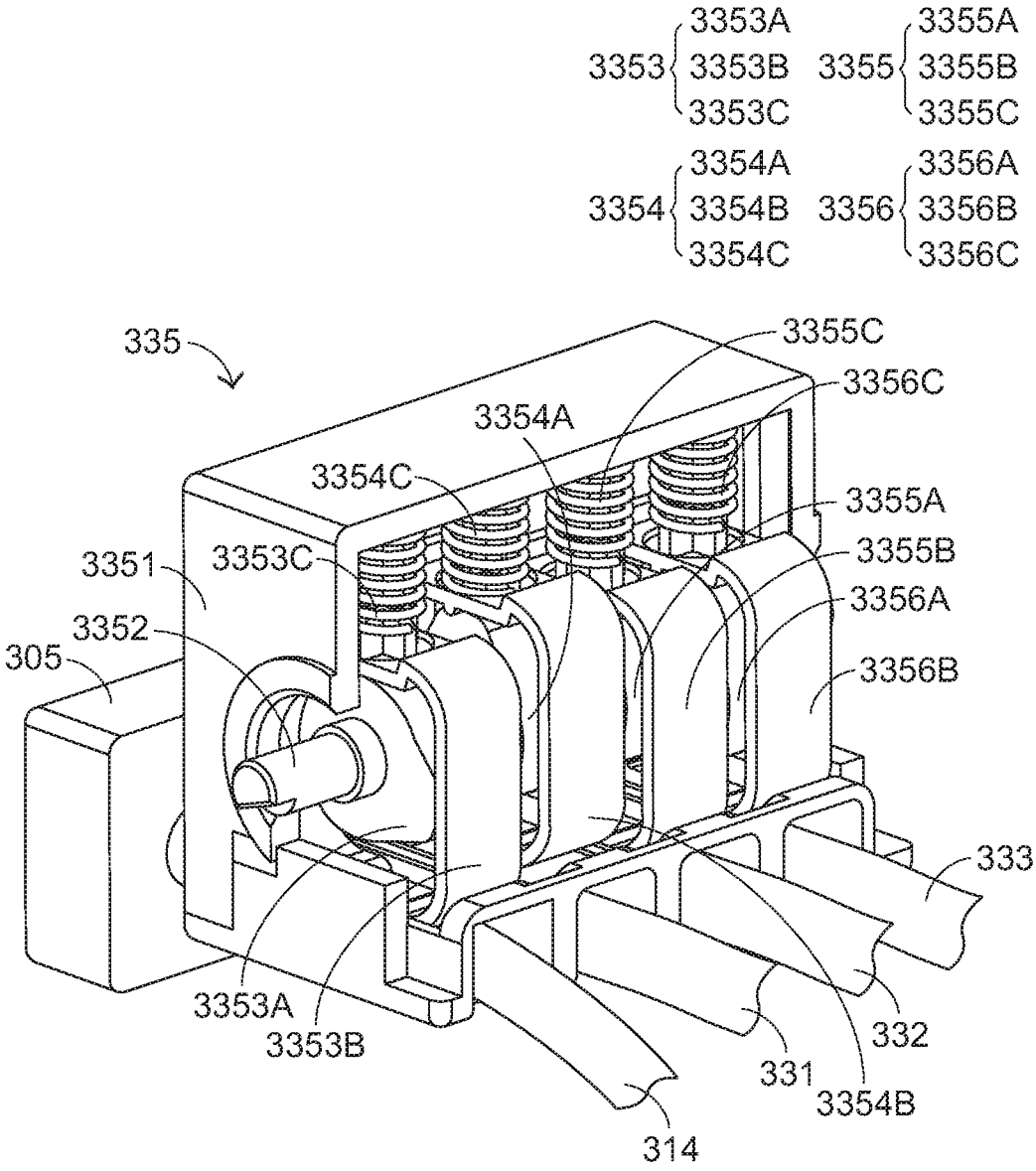
FIG. 13 is a schematic perspective view illustrating a portion of the second switching module of FIG. 11, in which the first duct is in the open status.

Hereinafter, the operations of the second switching module 335 will be illustrated with reference to FIG. 13. FIG. 13 is a schematic perspective view illustrating a portion of the second switching module of FIG. 11, in which the first duct is in the open status. In a case that the nozzle cleaning mechanism 33 is not activated and the nozzle cleaning mechanism 33 is in an initial status, the exhaust pipe 314, the first duct 331, the second duct 332 and the third duct 333 are pressed by the fourth gate mechanism 3353, the fifth gate mechanism 3354, the sixth gate mechanism 3355 and the seventh gate mechanism 3356, respectively. When the user finds that the first nozzle 272 of the inkjet printing device 2 is clogged, the user may activate the nozzle cleaning mechanism 33 to clean the first nozzle 272. After the nozzle cleaning mechanism 33 is activated, the connecting cover 344 is moved to a position under the first print head 27, the second print head 28 and the third print head 29. Then, the connecting cover 334 is moved toward the first print head 27, the second print head 28 and the third print head 29 in an upward direction. Consequently, the connecting cover 344 is connected with the first print head 27, the second print head 28 and the third print head 29. Under this circumstance, the first nozzle 272, the second nozzle and the third nozzle are covered by the first covering recess 3441, the second covering recess 3442 and the third covering recess 3443 of the connecting cover 344, respectively.

After the connecting cover 344 is connected with the first print head 27, the second print head 28 and the third print head 29, the user may operate an operating interface (not shown) to enable the second switching module 335 in order to rotate the rotating shaft 3352. For example, the operating interface is an operating button or a touchpad. In a case that the second cam 3354A of the fifth gate mechanism 3354 is rotated with the rotating shaft 3352 to be contacted with the second contact plate 3354B, the second contact plate 3354B is pushed by the second cam 3354A and the second contact plate 3354B is moved upwardly relative to the second casing 3351. Since the pushing force provided by the second cam 3354A is larger than the fifth elastic force provided by the fifth elastic element 3354C, the second contact plate 3354B is separated from the first duct 331. Under this circumstance, the first duct 331 is in the open status, but the second duct 332 and the third duct 333 are both in the close status. As mentioned above, the first cam 3353A, the second cam 3354A, the third cam 3355A and the fourth cam 3356A are arranged on the rotating shaft 3352 in the staggered form. Consequently, at the time when the second contact plate 3354B is pushed by the second cam 3354A, the first contact plate 3353B, the third contact plate 3355B and the fourth contact plate 3356B are not pushed by the first cam 3353A, the third cam 3355A and the fourth cam 3356A, respectively.

Then, the user may further operate the operating interface to turn on the power pump 301. Consequently, a suction force is generated by the power pump 301. Since the first duct 331 is in the open status, the regions between the suction pipe 302 and the first pint head 27 covered by the first covering recess 3341 are in communication with each other. Moreover, in response to the suction force, the first ink within the first ink chamber 271 is transferred to the power pump 301 through the first nozzle 272, the first covering recess 3341, the first duct 331, the second inlet 3053, the outlet 3051 and the suction pipe 302 sequentially. Afterwards, the sucked first ink is discharged to the discharge pipe 303 by the power pump 301, and transferred to the storage element 304. Since the first ink is transferred through the first nozzle 272, the clogged condition of the first nozzle 272 can be effectively eliminated. After the clogged condition of the first nozzle 272 is eliminated, the power pump 301 is turned off by the user, and thus the suction force is no longer generated. Under this circumstance, the nozzle cleaning task of the first nozzle 272 is competed.

The ways of eliminating the clogged conditions of the second nozzle and the third nozzle are similar to the way of eliminating the clogged condition of the first nozzle, and are not redundantly described herein. From the above discussions, in a case that the fourth gate mechanism 3353 is separated from the exhaust pipe 314 and thus the exhaust pipe 314 is in the open status, the ink refill mechanism 31 is in communication with the suction pipe 302. Under this circumstance, the first duct 331, the second duct 332 and the third duct 333 are respectively pressed by the fifth gate mechanism 3354, the sixth gate mechanism 3355 and the seventh gate mechanism 3356, and thus the first duct 331, the second duct 332 and the third duct 333 are all in the close status. Similarly, in a case that the fifth gate mechanism 3354 is separated from the first duct 331 and thus the first duct 331 is in the open status, the exhaust pipe 314, the second duct 332 and the third duct 333 are respectively pressed by the fourth gate mechanism 3353, the sixth gate mechanism 3355 and the seventh gate mechanism 3356. Under this circumstance, the exhaust pipe 314, the second duct 332 and the third duct 333 are all in the close status. Similarly, in a case that the sixth gate mechanism 3355 is separated from the second duct 332 and thus the second duct 332 is in the open status, the exhaust pipe 314, the first duct 331 and the third duct 333 are respectively pressed by the fourth gate mechanism 3353, the fifth gate mechanism 3354 and the seventh gate mechanism 3356. Under this circumstance, the exhaust pipe 314, the first duct 331 and the third duct 333 are all in the close status. Similarly, in a case that the seventh gate mechanism 3356 is separated from the third duct 333 and thus the third duct 333 is in the open status, the exhaust pipe 314, the first duct 331 and the second duct 332 are respectively pressed by the fourth gate mechanism 3353, the fifth gate mechanism 3354 and the sixth gate mechanism 3355. Under this circumstance, the exhaust pipe 314, the first duct 331 and the second duct 332 are all in the close status.

From the above discussions, since the cams of the second switching module 335 are oriented along different directions, the exhaust pipe 314, the first duct 331, the second duct 332 and the third duct 333 are not simultaneously in the open statue under control of the second switching module 335. That is, the second switching module 335 is capable of controlling the ink refill mechanism 31 to be in communication with the suction pipe 302 or controlling the nozzle cleaning mechanism 33 to be in communication with the suction pipe 302. Consequently, for cleaning the first nozzle, the first duct in communication with the first nozzle is in the open status, but the other ducts are in the close status. Whereas, for cleaning the second nozzle, the second duct in communication with the second nozzle is in the open status, but the other ducts are in the close status. Since the nozzle which is unneeded to be cleaned is not influenced by the suction force of the power pump, the purpose of saving ink is achieved In this embodiment, according to the preset settings, after the clogged conditions of the first nozzle 272, the second nozzle and the third nozzle are eliminated by the first ink, the second ink and the third ink that are transferred therethrough, the second switching module 335 will control all of the first duct 331, the second duct 332 and the third duct 333 to be in the close status. Alternatively, in some other embodiments, according to the preset settings, the second switching module may control all of the first duct, the second duct and the third duct to be in the open status In this embodiment, the nozzle cleaning mechanism 33 is applied to the inkjet printing device with three print heads, and thus the second switching module 335 of the nozzle cleaning mechanism 33 comprises four gate mechanisms corresponding to the three print heads and the exhaust pipe 314 of the ink refill mechanism 31. It is noted that the nozzle cleaning mechanism of the present invention may be applied to the inkjet printing device with another number of ink cartridges according to the practical requirements. For example, the nozzle cleaning mechanism of the present invention may be applied to the inkjet printing device with only a black ink cartridge and a color ink cartridge, and thus the second switching module of the nozzle cleaning mechanism comprises three gate mechanisms corresponding to the two print heads and the ink refill mechanism. Alternatively, the nozzle cleaning mechanism of the present invention may be applied to the inkjet printing device with four ink cartridges (i.e. a cyan (C) ink cartridge, a magenta (M) ink cartridge, a yellow (Y) ink cartridge and a black (K) ink cartridge), and thus the switching module of the nozzle cleaning mechanism comprises five gate mechanisms corresponding to the four print heads and the ink refill mechanism.

Moreover, in this embodiment, the inkjet printing device 2 comprises the ink refill mechanism 31 and the nozzle cleaning mechanism 33. The second switching module 335 is used for controlling the open/close statuses of the exhaust pipe 314 of the ink refill mechanism 31 or controlling open/close statuses of the first duct 331, the second duct 332 or the third duct 333 of the nozzle cleaning mechanism 33. Alternatively, in some other embodiments, the inkjet printing device 2 may comprise two pump modules. One of the pump modules is connected with the ink refill mechanism, and the other pump module is connected with the nozzle cleaning mechanism. Under this circumstance, the second switching module is located near nozzle cleaning mechanism without controlling the open/close statuses of the exhaust pipe of the ink refill mechanism.

From the above description, the present invention provides an inkjet printing device with an ink refill mechanism and a nozzle cleaning mechanism. Since a shared pump module is used with the ink refill mechanism and the nozzle cleaning mechanism collectively, the number of components is reduced and the overall volume of the inkjet printing device is not increased. In the inkjet printing device, the ink refill mechanism is used for performing the ink-refilling task. Consequently, the air within the first ink chamber or the second ink chamber may be ejected out through the first vent or the second vent. In comparison with the conventional inkjet printing device, the inkjet printing device is more advantageous because the bubbles within the ink can be effectively removed. Moreover, the at least one first transfer channel and the at least one second transfer channel of the channel plate of the ink refill mechanism are parallel with each other. At the time when the air within the first ink chamber and the second ink chamber is ejected to the first transfer channel and the second transfer channel, the first ink and the second ink are transferred to the first transfer channel and the second transfer channel along with the air. Since the first transfer channel and the second transfer channel are parallel with each other, the possibility of causing the clogged conditions of the first transfer channel and the second transfer channel by the first ink and the second ink will be minimized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An inkjet printing device, comprising:

a first ink cartridge for storing a first ink;

a second ink cartridge for storing a second ink;

a first ink pipe connected with said first ink cartridge, wherein said first ink is allowed to be transferred through said first ink pipe;

a second ink pipe connected with said second ink cartridge, wherein said second ink is allowed to be transferred through said second ink pipe;

a first print head connected with said first ink pipe, and comprising a first ink chamber, a first nozzle and a first vent;

a second print head connected with said second ink pipe, and comprising a second ink chamber, a second nozzle and a second vent;

an ink refill mechanism disposed under said first print head and said second print head, wherein when said ink refill mechanism is connected with said first vent and said second vent, said first ink within said first ink cartridge and said second ink within said second ink cartridge are allowed to be transferred to said first ink chamber and said second ink chamber through said first ink pipe and said second ink pipe, respectively, wherein said ink refill mechanism comprises:

a channel plate comprising a first transfer channel corresponding to said first vent and a second transfer channel corresponding to said second vent, wherein said first transfer channel and said second transfer channel are parallel with said channel plate, said first transfer channel has a first channel exit perpendicular to said channel plate, and said second transfer channel has a second channel exit perpendicular to said channel plate;

a first switching module connected with said first channel exit and said second channel exit for controlling open/close statues of said first transfer channel and said second transfer channel; and an exhaust pipe disposed under said first channel exit and said second channel exit, and located near said first channel exit and said second channel exit, wherein when said first transfer channel or said second transfer channel is in said open status, an air within said first ink chamber or said second ink chamber is allowed to be transferred through said exhaust pipe; and a pump module connected with said exhaust pipe for generating a suction force, wherein said air within said first ink chamber is sucked by said pump module in response to said suction force when said first transfer channel is in said open status, or said air within said second ink chamber is sucked by said pump module in response to said suction force when said second transfer channel is in said open status, wherein said pump module comprises:

a power pump for generating said suction force;

a suction pipe connected with said power pump;

a discharge pipe connected with said power pump, wherein after said first ink is transferred through said power pump in response to said suction force, said first ink is further transferred through said discharge pipe;

a storage element connected with said discharge pipe, wherein after said first ink is transferred through said discharge pipe, said first ink is stored within said storage element; and a coupling element arranged between said suction pipe and said exhaust pipe and said first duct, and connected with said suction pipe, said exhaust pipe and said first duct, wherein said coupling element comprises:

an outlet located at a first sidewall of said coupling element and connected with said suction pipe;

a first inlet located at a second sidewall of said coupling element and connected with said exhaust pipe, wherein said air within said first ink chamber is introduced into said coupling element through said first inlet and transferred to said suction pipe through said outlet; and a second inlet located at said second sidewall of said coupling element, located beside said first inlet, and connected with said first duct, wherein said first ink is introduced into said coupling element through said second inlet and transferred to said suction pipe through said outlet; and a nozzle cleaning mechanism, wherein said nozzle cleaning mechanism is located beside said ink refill mechanism and connected with said pump module, wherein when said nozzle cleaning mechanism is connected with said first nozzle, in response to said suction force generated by said pump module, a clogged condition of said first nozzle is eliminated by said nozzle cleaning mechanism, wherein said nozzle cleaning mechanism comprises:

a first duct connected with said pump module, wherein said first ink within said first ink cartridge is allowed to be transferred to said pump module through said first duct; and a second switching module located near said exhaust pipe and said first duct for controlling open/close statues of said first duct and said exhaust pipe, wherein when said exhaust pipe or said first duct is in said open status, in response to said suction force generated by said pump module, said air within said first ink chamber, said air within said second ink chamber or said first ink is transferred to said pump module.

2. The inkjet printing device according to claim 1, wherein said first switching module comprises:

a first gate mechanism inserted into said first channel exit for selectively unblocking or blocking said first channel exit, wherein when said first channel exit is unblocked, said first transfer channel is in said open status, wherein when said first channel exit is blocked, said first transfer channel is in said close status;

a second gate mechanism inserted into said second channel exit for selectively unblocking or blocking said second channel exit, wherein when said second channel exit is unblocked, said second transfer channel is in said open status, wherein when said second channel exit is blocked, said second transfer channel is in said close status; and a changeover switch located beside said first gate mechanism and said second gate mechanism to be selectively contacted with said first gate mechanism or said second gate mechanism, thereby driving said first gate mechanism or said second gate mechanism.

3. The inkjet printing device according to claim 2, wherein said first gate mechanism comprises:

a first sealing element disposed within said first channel exit, and comprising a first hole;

a first contact post inserted into said first channel exit and said first hole, and movable relative to said first channel exit;

a first pushing element disposed under said first contact post, and movable relative to said first channel exit, wherein when said first pushing element is pushed by said changeover switch, said first pushing element is correspondingly moved to push said first contact post, so that at least one first gap is formed between said first contact post and said first hole and said first channel exit is unblocked; and a first elastic element disposed within said first channel exit and contacted with said first contact post for providing a first elastic force to said first contact post, wherein in response to said first elastic force, said first channel exit is blocked by said first contact post.

4. The inkjet printing device according to claim 3, wherein said first contact post comprises:

a first contact part located at a first end of said first contact post, and inserted into said first channel exit, wherein a first surface of said first contact part is contacted with said first elastic element, and a second surface of said first contact part is contacted with said first sealing element; and a first notch part located at a second end of said first contact post, and inserted into said first hole to be selectively contacted with said first pushing element, wherein when said first notch part is not pushed by said first pushing element, said first hole is covered by said first contact part, so that said first channel exit is blocked, wherein when said first notch part is pushed by said first pushing element, said first notch part is moved upwardly relative to said first hole, so that said at least one first gap is formed between said first notch part and said first hole and said first channel exit is unblocked.

5. The inkjet printing device according to claim 3, wherein said first pushing element comprises:

a first pushing part located beside said changeover switch, wherein when said first pushing part is pushed by said changeover switch, said first pushing part is moved relative to said first channel exit; and a first thimble disposed on said first pushing part to be contacted with said first contact post, wherein when said first pushing part is pushed by said changeover switch, said first thimble is correspondingly moved to push said first contact post, so that said at least one first gap is formed between said first contact post and said first hole and said first channel exit is unblocked.

6. The inkjet printing device according to claim 2, wherein said second gate mechanism comprises:

a second sealing element disposed within said second channel exit, and comprising a second hole;

a second contact post inserted into said second channel exit and said second hole, and movable relative to said second channel exit;

a second pushing element disposed under said second contact post, and movable relative to said second channel exit, wherein when said second pushing element is pushed by said changeover switch, said second pushing element is correspondingly moved to push said second contact post, so that at least one second gap is formed between said second contact post and said second hole and said second channel exit is unblocked; and a second elastic element disposed within said second channel exit and contacted with said second contact post for providing a second elastic force to said second contact post, wherein in response to said second elastic force, said second channel exit is blocked by said second contact post.

7. The inkjet printing device according to claim 6, wherein said second contact post comprises:

a second contact part located at a first end of said second contact post, and inserted into said second channel exit, wherein a first surface of said second contact part is contacted with said second elastic element, and a second surface of said second contact part is contacted with said second sealing element; and a second notch part located at a second end of said second contact post, and inserted into said second hole to be selectively contacted with said second pushing element, wherein when said second notch part is not pushed by said second pushing element, said second hole is covered by said second contact part, so that said second channel exit is blocked, wherein when said second notch part is pushed by said second pushing element, said second notch part is moved upwardly relative to said second hole, so that said at least one second gap is formed between said second notch part and said second hole and said second channel exit is unblocked.

8. The inkjet printing device according to claim 6, wherein said second pushing element comprises:

a second pushing part located beside said changeover switch, wherein when said second pushing part is pushed by said changeover switch, said second pushing part is moved relative to said second channel exit; and a second thimble disposed on said second pushing part to be contacted with said second contact post, wherein when said second pushing part is pushed by said changeover switch, said second thimble is correspondingly moved to push said second contact post, so that said at least one second gap is formed between said second contact post and said second hole and said second channel exit is unblocked.

9. The inkjet printing device according to claim 2, wherein said first switching module further comprises a first casing, wherein said first gate mechanism and said second gate mechanism are partially enclosed by said first casing, wherein said changeover switch comprises:

a rotating part disposed on said first casing and rotatable relative to said first casing; and a pushing bulge disposed on an inner surface of said rotating part, wherein as said rotating part is rotated, said first gate mechanism or said second gate mechanism is pushed by said pushing bulge.

10. The inkjet printing device according to claim 1, wherein said ink refill mechanism further comprises:

a carrier for supporting said first switching module thereon;

a covering member disposed under said first channel exit and said second channel exit, and partially sheltered by said first switching module, wherein said covering member is connected with said exhaust pipe; and a swinging seat disposed under said carrier and contacted with said carrier for swinging said carrier to move said carrier upwardly or downwardly, wherein when said carrier is moved upwardly, said ink refill mechanism is connected with said first vent and said second vent, wherein when said carrier is moved downwardly, said ink refill mechanism is detached from said first vent and said second vent.

11. The inkjet printing device according to claim 1, wherein said second switching module comprises:

a second casing;

a rotating shaft disposed on said second casing and rotatable relative to said second casing;

a third gate mechanism connected with said rotating shaft and located near said exhaust pipe, wherein said third gate mechanism is oriented along a first direction, wherein as said rotating shaft is rotated, said exhaust pipe is pressed by said third gate mechanism or separated from said third gate mechanism, so that said exhaust pipe is in said close status or said open status; and a fourth gate mechanism connected with said rotating shaft, located beside said third gate mechanism, and located near said first duct, wherein said fourth gate mechanism is oriented along a second direction, wherein as said rotating shaft is rotated, said first duct is pressed by said fourth gate mechanism or separated from said fourth gate mechanism, so that said first duct is in said close status or said open status, wherein there is an included angle between said first direction and said second direction, wherein when said third gate mechanism is separated from said exhaust pipe, said first duct is pressed by said fourth gate mechanism, wherein when said third gate mechanism is separated from said first duct, said exhaust pipe is pressed by said fourth gate mechanism.

12. The inkjet printing device according to claim 11, wherein said third gate mechanism comprises:

a first cam disposed on said rotating shaft, and located near said exhaust pipe, wherein said first cam is oriented along said first direction, and said first cam is rotated with said rotating shaft;

a first contact plate disposed around said first cam and said rotating shaft, wherein when said first contact plate is not pushed by said first cam, said exhaust pipe is pressed by said first contact plate, so that said exhaust pipe is in said close status, wherein when said first cam is rotated and said first contact plate is pushed by said first cam, said first contact plate is moved relative to said second casing and separated from said exhaust pipe, so that said exhaust pipe is in said open status and said first duct is in said close status; and a third elastic element arranged between said second casing and said first contact plate and contacted with said second casing and said first contact plate for providing a third elastic force to said first contact plate, wherein when said first contact plate is not pushed by said first cam, in response to said third elastic force, said first contact plate is moved relative to said second casing to press said exhaust pipe.

13. The inkjet printing device according to claim 11, wherein said fourth gate mechanism comprises:

a second cam disposed on said rotating shaft, and located near said first duct, wherein said second cam is oriented along said second direction, and said second cam is rotated with said rotating shaft;

a second contact plate disposed around said second cam and said rotating shaft, wherein when said second contact plate is not pushed by said second cam, said first duct is pressed by said second contact plate, so that said first duct is in said close status, wherein when said second cam is rotated and said second contact plate is pushed by said second cam, said second contact plate is moved relative to said second casing and separated from said first duct, so that said first duct is in said open status and said exhaust pipe is in said close status; and a fourth elastic element arranged between said second casing and said second contact plate and contacted with said second casing and said second contact plate for providing a fourth elastic force to said second contact plate, wherein when said second contact plate is not pushed by said second cam, in response to said fourth elastic force, said second contact plate is moved relative to said second casing to press said first duct.

* * * * *